US006784857B1

(12) United States Patent
Nakamura

(10) Patent No.: US 6,784,857 B1
(45) Date of Patent: Aug. 31, 2004

(54) METHOD OF DRIVING A SUSTAINING PULSE FOR A PLASMA DISPLAY PANEL AND A DRIVER CIRCUIT FOR DRIVING A PLASMA DISPLAY PANEL

(75) Inventor: Tadashi Nakamura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/479,875

(22) Filed: Jan. 10, 2000

(30) Foreign Application Priority Data

Jan. 12, 1999 (JP) ..... 11-004923

(51) Int. Cl.[7] ..... G09G 3/28
(52) U.S. Cl. ..... 345/60; 345/63; 345/208
(58) Field of Search ..... 345/60, 65, 208–210, 345/61–64, 66–70, 211; 315/169.3, 169.4, 169.1, 169.2

(56) References Cited

U.S. PATENT DOCUMENTS 4,087,805 A * 5/1978 Miller ..... 340/324 M
4,087,807 A * 5/1978 Miavecz ..... 315/169
5,642,018 A * 6/1997 Marcotte ..... 315/169.4
5,745,086 A * 4/1998 Weber ..... 345/63
5,835,072 A * 11/1998 Kanazawa ..... 345/60
6,011,355 A * 1/2000 Nagai ..... 315/169.4
6,023,258 A * 2/2000 Kuriyama et al. ..... 345/208
6,211,865 B1 * 4/2001 Hosoi et al. ..... 345/204
6,236,165 B1 * 5/2001 Ishizuka ..... 315/169.1
6,323,851 B1 * 11/2001 Nakanishi ..... 345/211
6,426,732 B1 * 7/2002 Makino ..... 345/68
6,466,186 B1 * 10/2002 Shimizu et al. ..... 345/60

FOREIGN PATENT DOCUMENTS

| | | |
|---|---|---|
| JP | 3-175491 | 7/1991 |
| JP | 9-34397 | 2/1997 |
| JP | 9-81073 | 3/1997 |

* cited by examiner

*Primary Examiner*—Lun-Yi Lao
(74) *Attorney, Agent, or Firm*—Young & Thompson

(57) ABSTRACT

The first present invention provides a method of driving a sustaining pulse for a plasma display panel, wherein sustaining pulses are generated, which comprise plural sustaining discharge current supply pulses having different achieving voltage levels from each other and slope pulses, so that, after the slope pulses are generated and outputted, the sustaining discharge current supply pulses having the different achieving voltage levels are applied in sequence of a magnitude of difference between the different achieving voltage levels and a potential of a final one of the sustaining discharge current supply pulses.

19 Claims, 12 Drawing Sheets

Wc: sustaining electrode driving pulse waveform
Ws: scanning electrode driving pulse waveform Wc: sustaining electrode driving pulse waveform
Ws: scanning electrode driving pulse waveform

METHOD OF DRIVING A SUSTAINING PULSE FOR A PLASMA DISPLAY PANEL AND A DRIVER CIRCUIT FOR DRIVING A PLASMA DISPLAY PANEL

BACKGROUND OF THE INVENTION

The present invention relates to a method of driving a sustaining pulse for a plasma display panel and a driver circuit for driving a plasma display panel, and more particularly to a method of driving a sustaining pulse for a plasma display panel to keep sustaining discharges in stable intensity for each display cell independently from variation in load to the display cells as well as a driver circuit for driving a plasma display panel to keep sustaining discharges in stable intensity for each display cell independently from variation in load to the display cells.

The plasma display panel is advantageous in possible reduction in thickness thereof, and also in its large contrast in display without substantial flicker as well as advantageous in possible enlargement of its screen The plasma display panel is further advantageous in high response speed and realizing a multi-color display by utilizing a fluorescent material due to self-emission type display. In recent years, the plasma display panel has been becoming to be used widely in various fields of displays for computers and color-displays.

FIG. 1 is a circuit diagram illustrative of a conventional circuit configuration of a driver circuit for driving a display cell of a plasma display panel. The driver circuit is connected to a display cell 16. The driver circuit for driving the display cell 16 comprises an address driver 20, a scanning driver 21' and a sustaining driver 22'. The address driver 20 is connected through a data electrode 7 to the display cell 16. The scanning driver 21' is also connected through a scanning electrode 3 to the display cell 16. The sustaining driver 22' is also connected through a sustaining electrode 4 to the display cell 16. The display cell 16 has a panel static capacitance between the scanning electrode 3 and the sustaining electrode 4. The address driver 20 comprises a complementary MOS circuit which comprises a series connection of an n-channel MOS field effect transistor T11 and a p-channel MOS field effect transistor T10 between a ground line and a high voltage line Vd, wherein the high voltage line is connected to the p-channel MOS field effect transistor T10, whilst the ground line is connected to the n-channel MOS field effect transistor T11. The data electrode 7 is connected to an intermediate point between the p-channel MOS field effect transistor T10 and the n-channel MOS field effect transistor T11.

The scanning driver 21' comprises seven diodes D20, D21, D23, D31, D42, D52 and D54 and five n-channel MOS field effect transistors T21, T22, T23, T31 and T42 as well as two p-channel MOS field effect transistors T20 and T52. The scanning electrode 3 is connected to a first node N1 of the scanning driver 21'. The p-channel MOS field effect transistor T20 is connected in series between the first node N1 and a second node N2. The n-channel MOS field effect transistor T21 is connected in series between the first node N1 and a third node N3. The p-channel MOS field effect transistor T20 and the n-channel MOS field effect transistor T21 are connected in series between the second node N2 and the third node N3, and the first node as the intermediate point between the p-channel MOS field effect transistor T20 and the n-channel MOS field effect transistor T21 is connected to the scanning electrode 3. Two diodes D20 and D21 are connected in series between the second node N2 and the third node N3 in parallel to the series connection of the p-channel MOS field effect transistor T20 and the n-channel MOS field effect transistor T21. The diode D20 is connected between the first node N1 and the second node N2 in such a direction that the diode D20 allows a current from the first node N1 to the second node N2. The diode D21 is connected between the first node N1 and the third node N3 in such a direction that the diode D21 allows a current from the third node N3 to the first node N1. The second node N2 is connected to the sustaining driver 22'. The third node N3 is also connected to the sustaining driver 22'. The diode D23 and the n-channel MOS field effect transistor T23 are connected in series between the second node N2 and a voltage line Vbw which is applied with a voltage level Vbw. The diode D23 is connected between the second node N2 and the n-channel MOS field effect transistor T23 in such a direction that the diode D23 allows a current from the second node N2 to the n-channel MOS field effect transistor 723. The n-channel MOS field effect transistor T23 connected between the diode D23 and the voltage line Vbw. The diode D31 and the n-channel MOS field effect transistor T31 are connected in series between the second node N2 and a voltage line Vpe which is applied with a voltage level Vpe. The diode D31 is connected between the second node N2 and the n-channel MOS field effect transistor T31 in such a direction that the diode D31 allows a current from the second node N2 to the n-channel MOS field effect transistor T31. The n-channel MOS field effect transistor T31 connected between the diode D31 and the voltage line Vpe. The diode D42 and the n-channel MOS field effect transistor T42 are connected in series between the second node N2 and a voltage line Vs which is applied with a voltage level Vs. The diode D42 is connected between the second node N2 and the n-channel MOS field effect transistor T42 in such a direction that the diode D42 allows a current from the second node N2 to the n-channel MOS field effect transistor T42. The n-channel MOS field effect transistor T42 connected between the diode D42 and the voltage line Vs. The diode D54 and the n-channel MOS field effect transistor T22 are connected in series between the third node N3 and a voltage line Vw which is applied with a voltage level Vw. The diode D54 is connected between the third node N3 and the n-channel MOS field effect transistor T22 in such a direction that the diode D54 allows a current from the third node N3 to the n-channel MOS field effect transistor T22. The n-channel MOS field effect transistor T22 connected between the diode D54 and the voltage line Vw. The diode D52 and the p-channel MOS field effect transistor T52 are connected in series between the third node N3 and a ground line which is applied with a ground voltage level. The diode D52 is connected between the third node N3 and the p-channel MOS field effect transistor T52 in such a direction that the diode D52 allows a current from the p-channel MOS field effect transistor T52 to the third node N3. The p-channel MOS field effect transistor T52 connected between the diode D52 and the ground line.

The sustaining driver 22' also comprises five diodes D30, D40, D50, D60 and D61 and four n-channel MOS field effect transistors T30 and T32, T60 and T61 as well as a single p-channel MOS field effect transistor T50. A fourth node N4 is connected to the sustaining electrode 4. The diode D30 and the n-channel MOS field effect transistor T30 are connected in series between the fourth node N4 and a voltage line Vp which is applied with a voltage level Vp. The diode D30 is connected between the fourth node N4 and the n-channel MOS field effect transistor T30 in such a direction that the diode D30 allows a current from the fourth node N4 to the n-channel MOS field effect transistor T30. The n-channel MOS field effect transistor T30 connected between the diode D30 and the voltage line Vp. The diode D40 and the n-channel MOS field effect transistor T32 arc connected in series between the fourth node N4 and a voltage line Vs which is applied with a voltage level Vs. The diode D40 is connected between the fourth node N4 and the n-channel MOS field effect transistor T32 in such a direction that the diode D40 allows a current from the fourth node N4 to the n-channel MOS field effect transistor T32. The n-channel MOS field effect transistor T32 connected between the diode D40 and the voltage line Vs. The diode D50 and the p-channel MOS field effect transistor T50 are connected in series between the fourth node N4 and a ground line which is applied with a ground potential. The diode D50 is connected between the fourth node N4 and the p-channel MOS field effect transistor T50 in such a direction that the diode D50 allows a current from the p-channel MOS field effect transistor T50 to the fourth node N4. The p-channel MOS field effect transistor T50 connected between the diode D50 and the ground line. The fourth node N4 is also connected through a reactance L60 to a fifth node N5. The diode D60 and the n-channel MOS field effect transistor T60 are connected in series between the fifth node N5 and the third node N3 of the scanning driver 21'. The diode D60 is connected between the third node N3 and the n-channel MOS field effect transistor T60 in such a direction that the diode D60 allows a current from the n-channel MOS field effect transistor T60 to the third node N3. The n-channel MOS field effect transistor T60 connected between the diode D60 and the fifth node N5. The diode D61 and the n-channel MOS field effect transistor T61 are also connected in series between the fifth node N5 and the second node N2 of the scanning driver 21'. The diode D61 is connected between the second node N2 and the n-channel MOS field effect transistor T61 in such a direction that the diode D61 allows a current from the second node N2 to the n-channel MOS field effect transistor T61. The n-channel MOS field effect transistor T61 connected between the diode D61 and the fifth node N5.

The above circuit operates as follows. In a preliminary discharge time period, the n-channel MOS field effect transistor T30 turns ON, so that the diode D30 causes the fourth node N4 and the sustaining electrode 4 to have the voltage level Vp, whereby a preliminary discharge pulse Pp is applied to the sustaining electrode 4. Concurrently, the p-channel MOS field effect transistor T52 is placed in the ON state, so that the series connection of the diodes D52 and D21 keeps the scanning electrode 3 in the ground potential.

Thereafter, the n-channel MOS field effect transistor T31 turns ON, so that series connection of the diodes D31 and D20 causes the second node N2 and the scanning electrode 3 to have the voltage level Vpe, whereby a preliminary discharge erasing pulse Ppe is applied to the scanning electrode 3. Concurrently, the p-channel MOS field effect transistor T50 is placed in the ON state, so that the diode D50 causes the sustaining electrode 4 to have the ground potential.

During the above preliminary discharge time period, the p-channel MOS field effect transistor T10 remains OFF state whilst the n-channel MOS field effect transistor T11 remains ON state, so that the data electrode 7 remains to have the ground level.

In a writing discharge time period, the n-channel MOS field effect transistor T23 turns ON, so that series connection of the diodes D23 and D20 causes the second node N2 and the scanning electrode 3 to have the voltage level Vbw. Concurrently, the p-channel MOS field effect transistor T50 is placed in the ON state, so that the diode D50 causes the sustaining electrode 4 to have the ground potential. Further, the n-channel MOS field effect transistor T22 is placed in the ON state. In these states, the n-channel MOS field effect transistor T21 is selectively switched into the ON state, so that the potential of the first node N1 and the scanning electrode 3 is dropped to the voltage level Vw, whereby the scanning pulse Pw is applied to the scanning electrode 3. For carrying out the writing discharge, in response to this scanning pulse Pw, the p-channel MOS field effect transistor T10 turns ON whilst the n-channel MOS field effect transistor T11 turns OFF, so that the data electrode 7 becomes to have the voltage level Vd, whereby the data pulse is applied to the data electrode 7.

A sustaining pulse may be obtained by various methods, for example, a power recovery method disclosed in Japanese Patent Publication No. 2755201 as mentioned below. The following operations are to apply a negative potential sustaining pulse to the sustaining electrode 4. The n-channel MOS field effect transistor T61 turns ON, so that charges accumulated in the panel static capacitance Cp are caused to flow through the scanning electrode 3, the diodes D20 and D61 and further through the n-channel MOS field effect transistor T61 and the reactance L60 to the fourth node N4 and the sustaining electrode 4, whereby a resonance phenomenon is caused to charge opposite-polarity charges to the panel capacitance Cp. As a result, the scanning electrode 3 is made into the potential G0 and the sustaining electrode 4 is made into the potential Vs0.

Thereafter, in order to supply the sustaining discharge current, the n-channel MOS field effect transistor T32 turns ON, so that the potential of the fourth node N4 and the sustaining electrode 4 is dropped into the voltage level Vs. Concurrently, the p-channel MOS field effect transistor T52 turns ON, so that the potential of the first node N1 and the scanning electrode 3 is risen up to the ground level GND.

The following operations are to apply a negative potential scanning pulse to the scanning electrode 3. The n-channel MOS field effect transistor T60 turns ON, so that charges accumulated in the panel static capacitance Cp are caused to flow through the sustaining electrode 4, the fourth node N4, the reactance L60 and further through the n-channel MOS field effect transistor T60 and the diodes D60 and D21 to the scanning electrode 3, whereby a resonance phenomenon is caused to charge opposite-polarity charges to the panel capacitance Cp. As a result, the sustaining electrode 4 is made into the potential G0 and the scanning electrode 3 is made into the potential Vs0.

Thereafter, in order to supply the sustaining discharge current, the n-channel MOS field effect transistor T42 turns ON, so that the potential of the first node N1 and the scanning electrode 3 is dropped to the voltage level Vs. Concurrently, the p-channel MOS field effect transistor T50 turns ON, so that the potential of the fourth node N4 and the sustaining electrode 4 is risen to the ground level GND.

The above operations are repeated to alternate the potential levels of the scanning electrode 3 and the sustaining electrode 4, thereby carrying out the required sustaining discharge. For the plasma display, it is easy to select light-ON or OFF, however difficult to adjust analogically the brightness. If the images are required to be displayed in multi-grayscale, then a sub-field method is utilized. The display cells on the plasma display show luminescence upon application of the sustaining pulse under the condition that the charges are written or charged to the capacitance. In the sub-field method, the brightness of the display cell is considered to be integral effects of integrating the visibility, and the number of applications of the sustaining pulse is adjusted to adjust the brightness of the display cell. One frame as a main frame of the display screen is divided into plural sub-fields where intervals for applying sustaining pulses as the driving pulses are different depending upon individual sub-fields. For example, image signals comprise 6 bits binary scales to display an image in 64 grayscales. FIG. 2 is a diagram illustrative of timings of applications of sustaining pulses for individual sub-fields SF1, SF2, SF3, SF4, SF5 and SF6 in one frame. The one frame is divided into six sub-fields SF1, SP2, SF3, SF4, SF5 and SF6. In the first sub-field SF1, after the preliminary discharge time period and the writing discharge time period, a first sustaining discharge time period exists which corresponds to one time application of the sustaining pulse. In the second sub-field SF2 following to the first sub-field SF1, after the same preliminary discharge time period and the same writing discharge time period as those in the first sub-field SF1, a second sustaining discharge time period exists which corresponds to two times application of the sustaining pulse. In the third sub-field SF3 following to the second sub-field SP2, after the same preliminary discharge time period and the same writing discharge time period as those in the second sub-field SF2, a third sustaining discharge time period exists which corresponds to four times application of the sustaining pulse. In the fourth sub-field SF4 following to the third sub-field SF3, after the same preliminary discharge time period and the same writing discharge time period as those in the third sub-field SF3, a fourth sustaining discharge time period exists which corresponds to eight times application of the sustaining pulse. In the fifth sub-field SF5 following to the fourth sub-field SF4, after the same preliminary discharge time period and the same writing discharge time period as those in the fourth sub-field SF4, a fifth sustaining discharge time period exists which corresponds to sixteen times application of the sustaining pulse In the sixth sub-field SF6 following to the fifth sub-field SF5, after the same preliminary discharge time period and the same writing discharge time period as those in the fifth sub-field SF5, a sixth sustaining discharge time period exists which corresponds to thirty two times application of the sustaining pulse. Those various sustaining pulse sub-field application time periods are optionally alone or in combination so that 64 different sustaining pulse one frame application time periods may be obtained, for which reason it is possible to realize the 64 gray-scales display corresponding to the number of the applications of the sustaining pulse in the one frame, so that the brightness corresponding to the 64 gray-scales corresponding to 64 different sustaining pulse application time periods are obtained.

The above conventional technique has the following problems. If the number of the luminescent cells are changed whereby a display load is changed in the sustaining discharge time period, variations in the sustaining discharge current to be supplied to the individual display cells is caused by resistances of the scanning electrode 3 and the sustaining electrode 4 and also by output impedance of the sustaining discharge current supply circuit, for which reason even the number of the pulses is the same for the display cells, the brightness is different between the display cells. If the display load of each sub-field is varied, then the 64 brightness levels are not uniformly varied, whereby adjacent two upper and lower brightness levels are inverted so that an upper brightness level, which should have to be upper than an adjacent lower brightness level, may actually be lower than the adjacent lower brightness level. It is no longer possible to obtain correct image display, resulting in a remarkable deterioration in image quality. Even if the adjacent two upper and lower brightness levels are not inverted, then it is no longer possible to obtain accurate grayscales whereby the display quality is poor.

FIG. 3A is a diagram illustrative of waveforms sustaining pulse and sustaining discharge current for each display cell in the prior art, where a display load is small. FIG. 3B is a diagram illustrative of waveforms sustaining pulse and sustaining discharge current for each display cell in the prior art, where a display load is large. If the display load is small, then a distortion of the sustaining pulse waveform is also small and a peak value of the sustaining discharge current is large. If, however, the display load is large, then a distortion of the sustaining pulse waveform is also large and a peak value of the sustaining discharge current is small. Further, the peak value of the discharge current is almost proportional to the brightness, for which reason if the display load is small, then the brightness is increased. If, however, the display load is large, then the brightness is decreased.

In the above circumstances, it had been required to develop a novel driver circuit for driving a sustaining pulse for a plasma display panel and a novel method of driving a sustaining pulse for the plasma display panel free from the above problem.

SUMMARY OF THE INVENTION

Accordingly, it is an object of the present invention to provide a novel driver circuit for driving a sustaining pulse for a plasma display panel free from the above problems.

It is a further object of the present invention to provide a novel driver circuit for driving a sustaining pulse for a plasma display panel, which is capable of keeping the stability of intensity of the sustaining discharge current for each display cell independently from variation of the display load.

It is a still further object of the present invention to provide a novel method of driving a sustaining pulse for a plasma display panel free from the above problems.

It is yet a further object of the present invention to provide a novel method of driving a sustaining pulse for a plasma display panel, which is capable of keeping the stability of intensity of the sustaining discharge current for each display cell independently from variation of the display load.

The first present invention provides a method of driving a sustaining pulse for a plasma display panel, wherein sustaining pulses are generated, which comprise plural sustaining discharge current supply pulses having different achieving voltage levels from each other and slope pulses, so that, after the slope pulses are generated and outputted, the sustaining discharge current supply pulses having the different achieving voltage levels are applied in sequence of a magnitude of difference between the different achieving voltage levels and a potential of a final one of the sustaining discharge current supply pulses.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DISCLOSURE OF THE INVENTION

Figure 1:
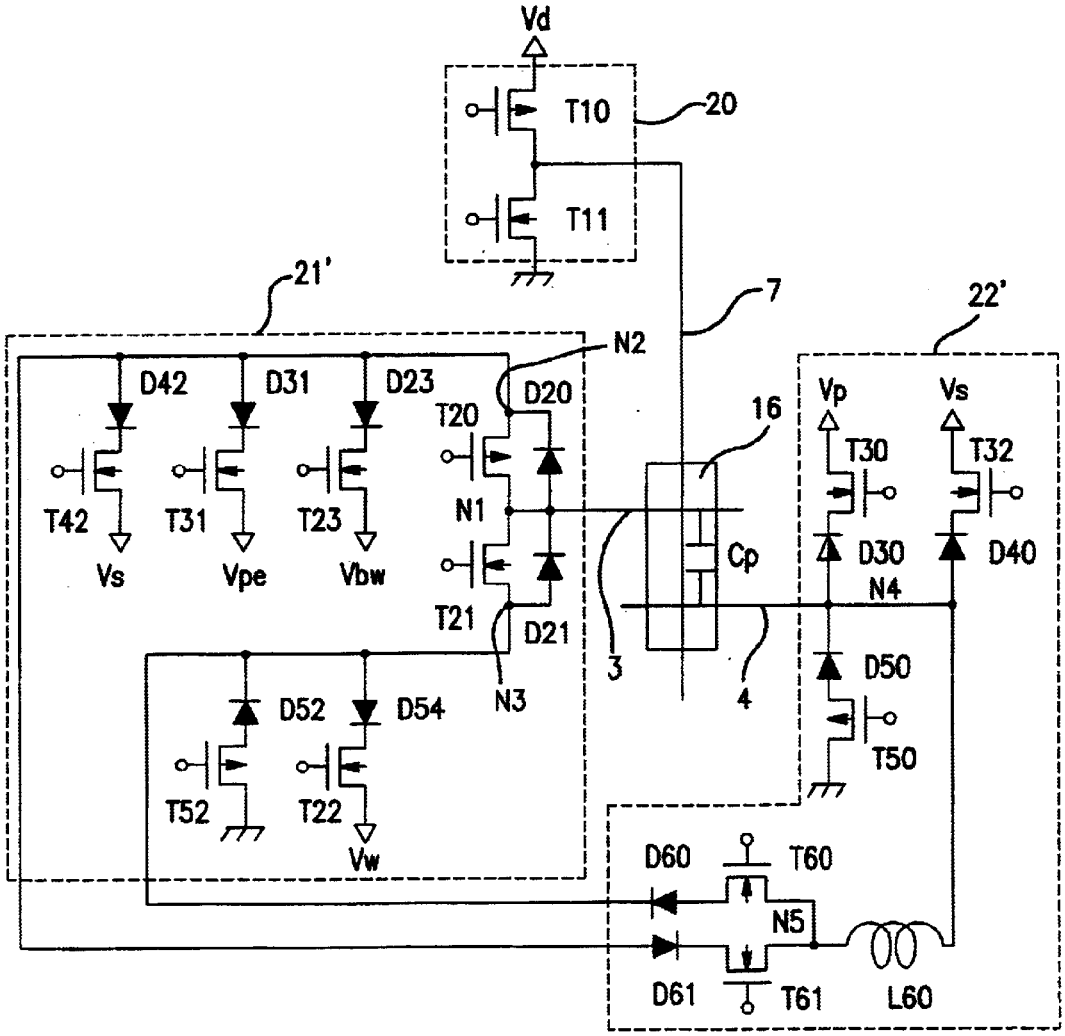
FIG. 1 PRIOR ART
FIG. 1 is a circuit diagram illustrative of a conventional circuit configuration of a driver circuit for driving a display cell of a plasma display panel.
Figure 2:
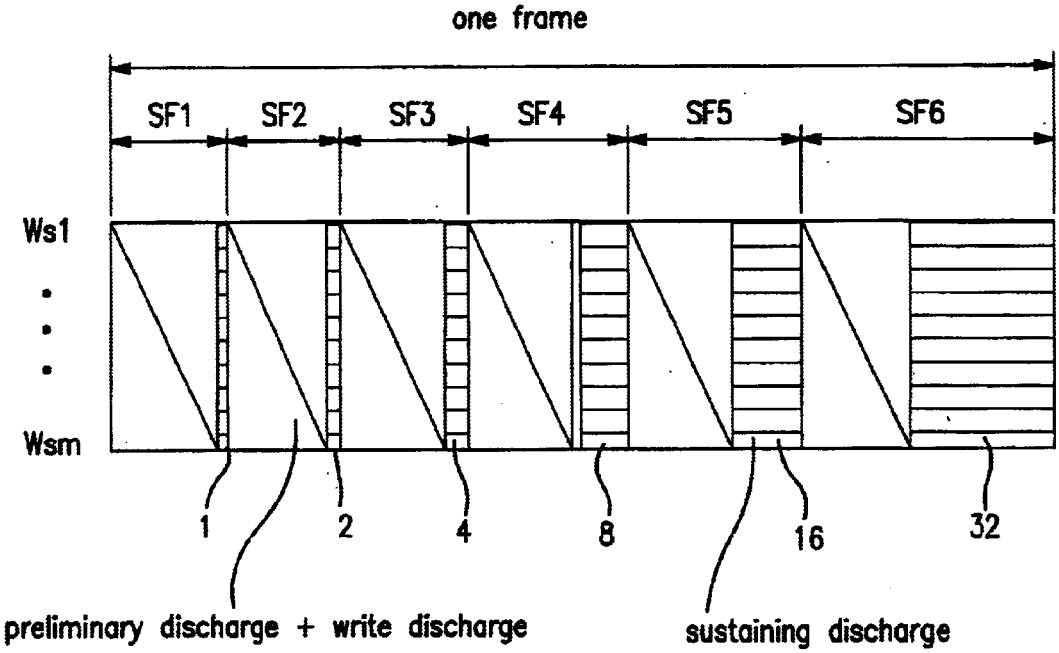
FIG. 2 PRIOR ART
FIG. 2 is a diagram illustrative of timings of applications of sustaining pulses for individual sub-fields SF1, SF2, SF3, SF4, SF5 and SF6 in one frame.
Figure 3A:
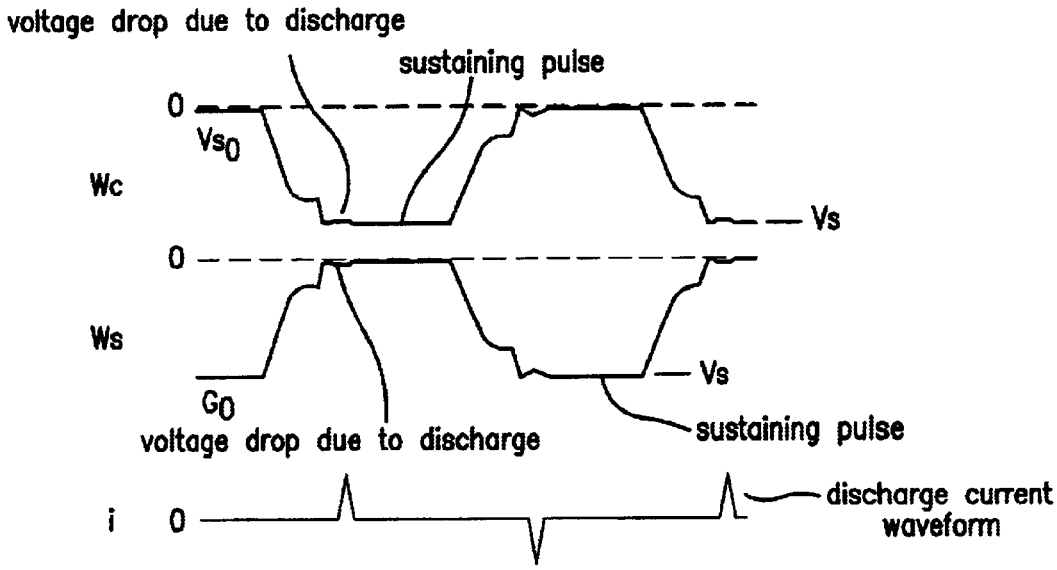
FIG. 3A PRIOR ART
FIG. 3A is a diagram illustrative of waveforms sustaining pulse and sustaining discharge current for each display cell in the prior art, where a display load is small.
Figure 3B:
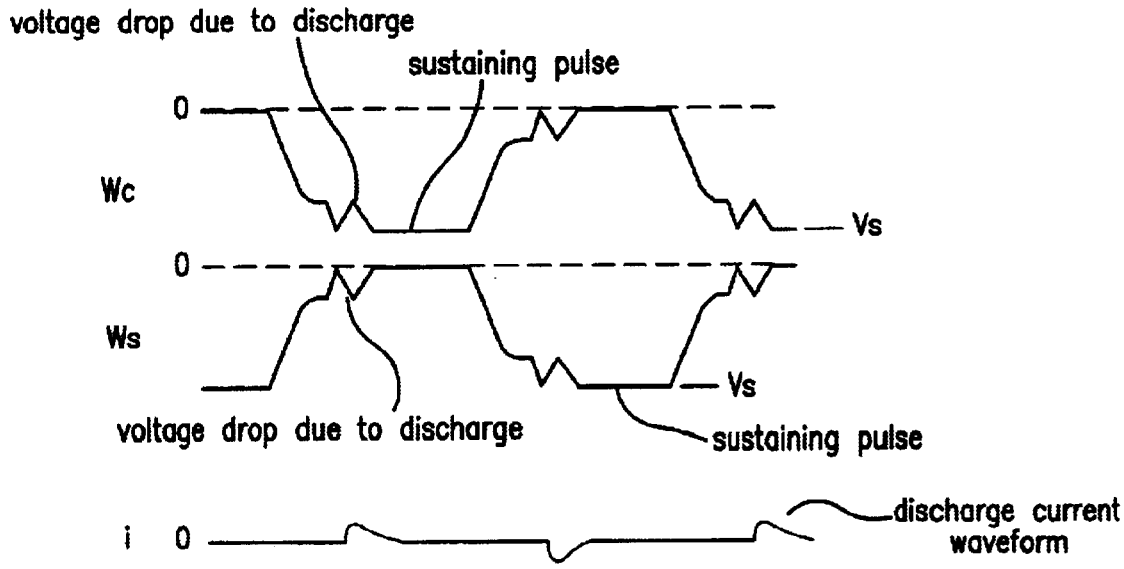
FIG. 3B PRIOR ART
FIG. 3B is a diagram illustrative of waveforms sustaining pulse and sustaining discharge current for each display cell in the prior art, where a display load is large.

The first aspect of the present invention provides a method of driving a sustaining pulse for a plasma display panel, wherein sustaining pulses are generated, which comprise plural sustaining electrode driving pulses having different achieving voltage levels from each other and slope pulses, so that, after than the final resistance encountered by the sustaining pulse;

a scanning circuit with a third switch connected between the source of the first potential and a scanning electrode, the scanning electrode applying a sustaining pulse to the plasma display panel;

the scanning circuit also having a fourth switch connected between the source of the first potential and the scanning electrode.

It is preferable that voltage levels of the sustaining pulses at an initial applying time is controlled and at least one of a sustaining discharge current and a sustaining discharge applying time period is also controlled for a sustaining discharge to a discharge cell.

The second aspect of the present invention provides a method of driving a sustaining pulse for a plasma display panel, wherein sustaining pulses are generated, which comprise plural sustaining pulses having different output impedance levels from each other and slope pulses, so that, after the slope pulses are generated and outputted, the sustaining pulses having the different impedance levels are applied in sequence of a magnitude of difference between the output impedance levels and a potential of a final one of the sustaining pulses.

It is preferable that voltage levels of the sustaining pulses at an initial applying time are controlled and at least one of a sustaining discharge current and a sustaining discharge applying time period is also controlled for a sustaining discharge to a discharge cell.

The third aspect of the present invention provides a driver circuit for a plasma display panel, comprising: a circuit for generating a sustaining pulses, which comprise plural sustaining electrode driving pulses having different achieving voltage levels from each other and slope pulses; and a circuit for applying, after the slope pulses are generated and outputted, the sustaining pulses having the different achieving voltage levels in sequence of a magnitude of difference between the different achieving voltage levels and a potential of a final one of the sustaining discharge current supply pulses.

It is preferable that the invention further comprises: a circuit for controlling voltage levels of the sustaining pulses at an initial applying time; and a circuit for controlling at least one of a sustaining discharge current and a sustaining discharge applying time period for a sustaining discharge to a discharge cell.

The fourth aspect of the present invention provides a driver circuit for a plasma display panel, comprising: a circuit for generating sustaining pulses, which comprise plural sustaining electrode driving pulses having different output impedance levels from each other and slope pulses; and a circuit for applying, after the slope pulses are generated and outputted, the sustaining discharge current supply pulses having the different impedance levels are applied in sequence of a magnitude of difference between the output impedance levels and a potential of a final one of the sustaining discharge current supply pulses.

It is preferable that the invention further comprises: a circuit for controlling voltage levels of the sustaining pulses at an initial applying time; and a circuit for controlling at least one of a sustaining discharge current and a sustaining discharge applying time period for a sustaining discharge to a discharge cell.

PREFERRED EMBODIMENT

First Embodiment

Figure 4:
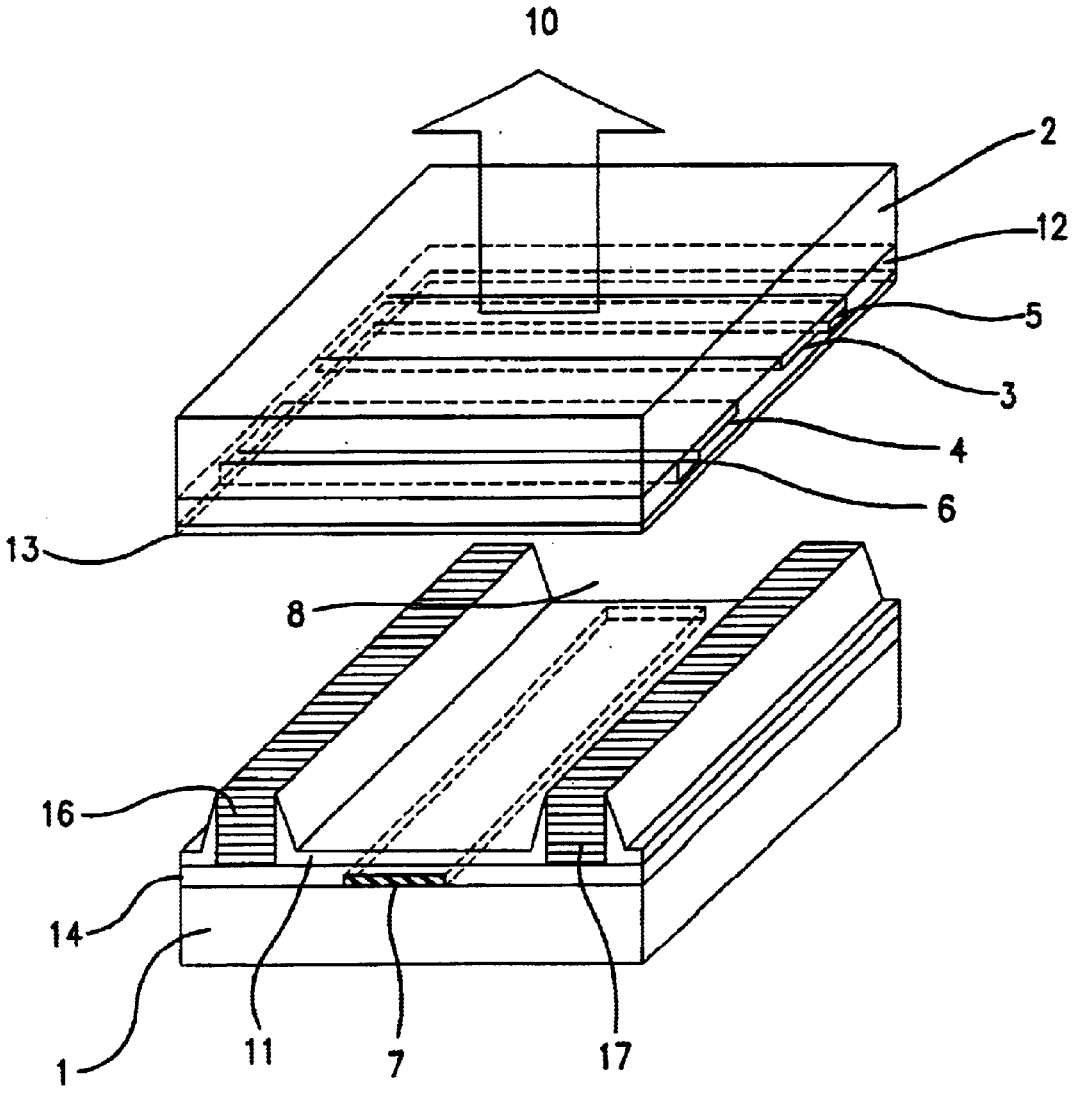
FIG. 4 is a schematic view illustrative of one display cell of a plasma display panel 15 operable in an alternating current discharge mode in a first embodiment in accordance with the present invention.

A first embodiment according to the present invention will be described in detail with reference to the drawings. FIG. 4 is a schematic view illustrative of one display cell of a plasma display panel 15 operable in an alternating current discharge mode in a first embodiment in accordance with the present invention. The plasma display panel 15 is advantageous in possible reduction in thickness thereof, and also in its large contrast in display without substantial flicker as well as advantageous in possible enlargement of its screen. The plasma display panel is further advantageous in high response speed and realizing a multi-color display by utilizing a fluorescent material due to self-emission type display. In recent years, the plasma display panel has been becoming to be used widely in various fields of displays for computers and color-displays.

The plasma display panel 15 is classified into two types, one is the alternating current discharge type where the display is operated by an alternating current discharge in a discharge space between electrodes coated with dielectric films, and another is the direct current discharge type where the display is operated by a direct current discharge in a discharge space between exposed electrodes. The alternating current discharge plasma display panel is further classified into two types of driving system, one is the memory operation type utilizing the memory characteristic of the discharge cell, and another is the refresh operation type not utilizing the memory characteristic of the discharge cell. The alternating current discharge type plasma display panel of FIG. 4 is of the memory operation type, The brightness of the plasma display panel is proportional to the number of discharge or the number of repeating the pulses. The alternating current discharge plasma display panel of the refresh operation type is suitable to the requirement for a small display capacity as if the display capacity is large, then the brightness is deteriorated.

The discharge cell 15 is defined between first and second insulating substrates 1 and 2 which are made of a glass. The first insulating substrate 1 is positioned in a back side and the second insulating substrate 2 is positioned in a front side. On an inside surface of the second insulating substrate 2, a stripe shaped scanning electrode 3 and a stripe shaped sustaining electrode 4 extend at a distance in parallel to each other and in a first lateral direction. A first trace electrode 5, which is stripe-shaped, is laminated on a selected part of the scanning electrode 3 in order to reduce a resistance of the scanning electrode 3. The first trace electrode 5 extends in the same direction as the scanning electrode 3. A second trace electrode 6, which is stripe-shaped, is laminated on a selected part of the sustaining electrode 4 in order to reduce a resistance of the sustaining electrode 4. The second trace electrode 6 extends in the same direction as the sustaining electrode 4. On an inside surface of the first insulating substrate 1, a stripe shaped data electrode 7 extends in a second lateral direction which is perpendicular to the first lateral direction along which the scanning electrode 3 and the sustaining electrode 4 extend. A first dielectric layer 14 is provided which covers the entire inside surface of the first insulating substrate 1, so that the data electrode 7 is covered with the first dielectric layer 14, A pair of first and second stripe-shaped ridges 16 and 17 is provided on the first dielectric layer 14, so that the first and second stripe-shaped ridges 16 and 17 extend in parallel to each other and also parallel to the data electrode 7. The first and second stripe-shaped ridges 16 and 17 are distanced so that the first and second stripe-shaped ridges 16 and 17 extend in opposite sides of the data electrode 7 but are separated from opposite side edges of the data electrode 7. A fluorescent material 11 is provided on the surface of the first dielectric layer 14 and also on side walls of the first and second stripe-shaped ridges 16 and 17. The above scanning electrode 3, the sustaining electrode 4, and the first and second trace electrodes 5 and 6 are transparent to allow a light to be transmitted through them. A second dielectric layer 12 is also provided which covers an entire inside surface of the second insulating substrate 2 so that the scanning electrode 3, the sustaining electrode 4, and the first and second trace electrodes 5 and 6 are covered with the second dielectric layer 12. A protective layer 13 is further provided on the second dielectric layer 12. A discharge space 8 is defined between the protective layer 13 and the fluorescent material 11 and also between the first and second ridges 16 and 17. The discharge space 8 is filled with a discharge gas, for example, a helium gas, a neon gas, a xenon gas or a mixture gas thereof, so that a discharge in the discharge space 8 filled with the discharge gas causes an ultraviolet ray and this ultraviolet ray is converted by the fluorescent material 11 into a visible light 10.

A discharge operation of the display cell will be described. A pulse voltage which is higher than a threshold voltage level is applied across the scanning electrode 3 and the data electrode 7 in order to cause a discharge in the discharge space 8. In accordance to the polarity of the pulse voltage, positive and negative charges are attracted in opposite directions and deposited on surfaces of the first and second dielectric layers 12 and 14. The depositions of the positive and negative charges on the surfaces of the first and second dielectric layers 12 and 14 in accordance to the polarity of the pulse voltage cause an equivalent internal voltage as wall voltage which is an opposite polarity to the pulse voltage, for which reason a growth of the discharge causes a drop of the effective voltage of the inside of the discharge cell. Even the pulse voltage is maintained to be constant, the discharge is likely to be gradually weaken. In order to sustain the discharge, a sustaining pulse having the same polarity as the wall voltage is applied across the scanning electrode 3 and the sustaining electrode 4, so that the wall voltage due to the depositions of the positive and negative charges on the first and second dielectric layers 12 and 14 is superimposed as the effective voltage, whereby even the voltage amplification of the sustaining pulse is lower than the discharge threshold level, the discharge is caused. Therefore, the sustaining pulse is alternately applied across the scanning electrode 3 and the sustaining electrode 4 in order to sustain the discharge in the discharge space 8. Sustaining the discharge has a function of memory. This sustaining discharge may be discontinued by applying a wide and low voltage pulse such as to neutralize the wall voltage or applying an erasing pulse as the width-reduced pulse which corresponds to a width-reduced sustaining discharge pulse voltage.

Figure 5:
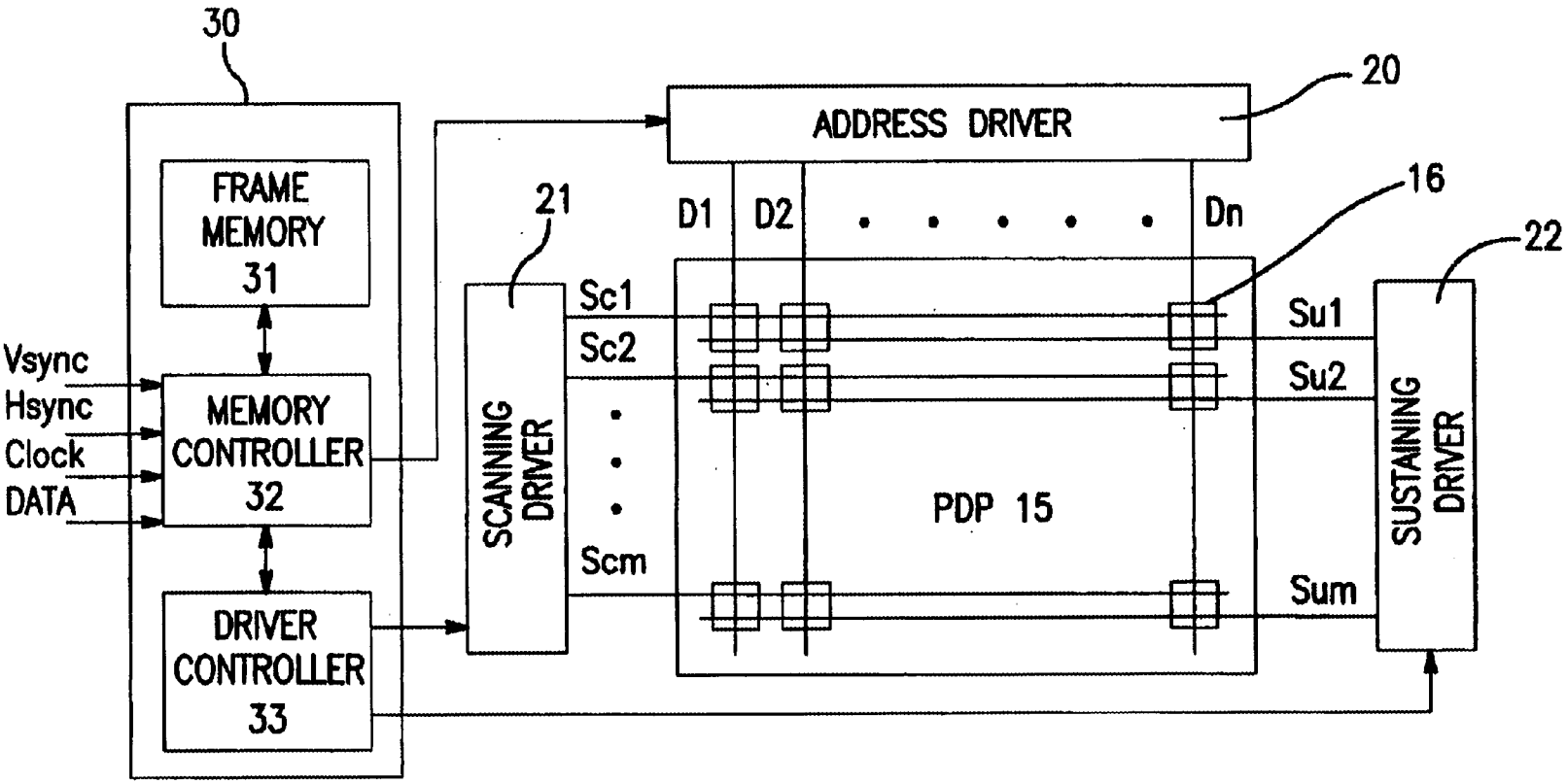
FIG. 5 is a block diagram illustrative of a display device including a plasma display panel, a control circuit, an address driver, a scanning driver and a sustaining driver in accordance with the present invention.

FIG. 5 is a block diagram illustrative of a display device including a plasma display panel, a control circuit, an address driver, a scanning driver and a sustaining driver in accordance with the present invention.

A plasma display panel 15 comprises an m×n array of display cells 16 for bot matrix display, The scanning electrodes Sc1, Sc2, Sc3, - - - Scm and the sustaining electrodes Su1, Su2, - - - Sum are provided as the row electrodes whilst the data electrodes D1, D2, - - - Dn are provided as the column electrodes which extend perpendicular to the scanning electrodes Sc1, Sc2, Sc3, - - - Scm and the sustaining electrodes Su1, Su2, - - - Sum. A scanning driver 21 is connected to the scanning electrodes Sc1, Sc2, Sc3, - - - Scm, so as to apply scanning electrode driving pulses to the scanning electrodes Sc1, Sc2, Sc3, - - - Scm. A sustaining driver 22 is connected to the sustaining electrodes Su1, Su2, - - - Sum so as to apply sustaining electrode driving pulses to the sustaining electrodes Su1, Su2, - - - Sum. An address driver 20 is connected to the data electrodes D1, D2, - - - Dn so as to apply data electrode driving pulses to the data electrodes D1, D2, - - - Dn. A control circuit 30 comprises a frame memory 31, a signal processor and memory controller 32, and a driver controller 33. The signal processor and memory controller 32 receives a vertical synchronizing signal Vsync, a horizontal synchronizing signal Hsync, a clock signal Clock, and a data signal DATA. The address driver 20 is connected to the signal processor and memory controller 32 in the control circuit 30 for receiving an address driver control signal from the signal processor and memory controller 32, so that the address driver 20 is operated in accordance with the address driver control signal. The scanning driver 21 is connected to the driver controller 33 in the control circuit 30 for receiving a scanning driver control signal from the driver controller 33, so that the scanning driver 21 is operated in accordance with the scanning driver control signal. The sustaining driver 22 is connected to the driver controller 33 in the control circuit 30 for receiving a sustaining driver control signal from the driver controller 33, so that the sustaining driver 22 is operated in accordance with the sustaining driver control signal.

Figure 6:
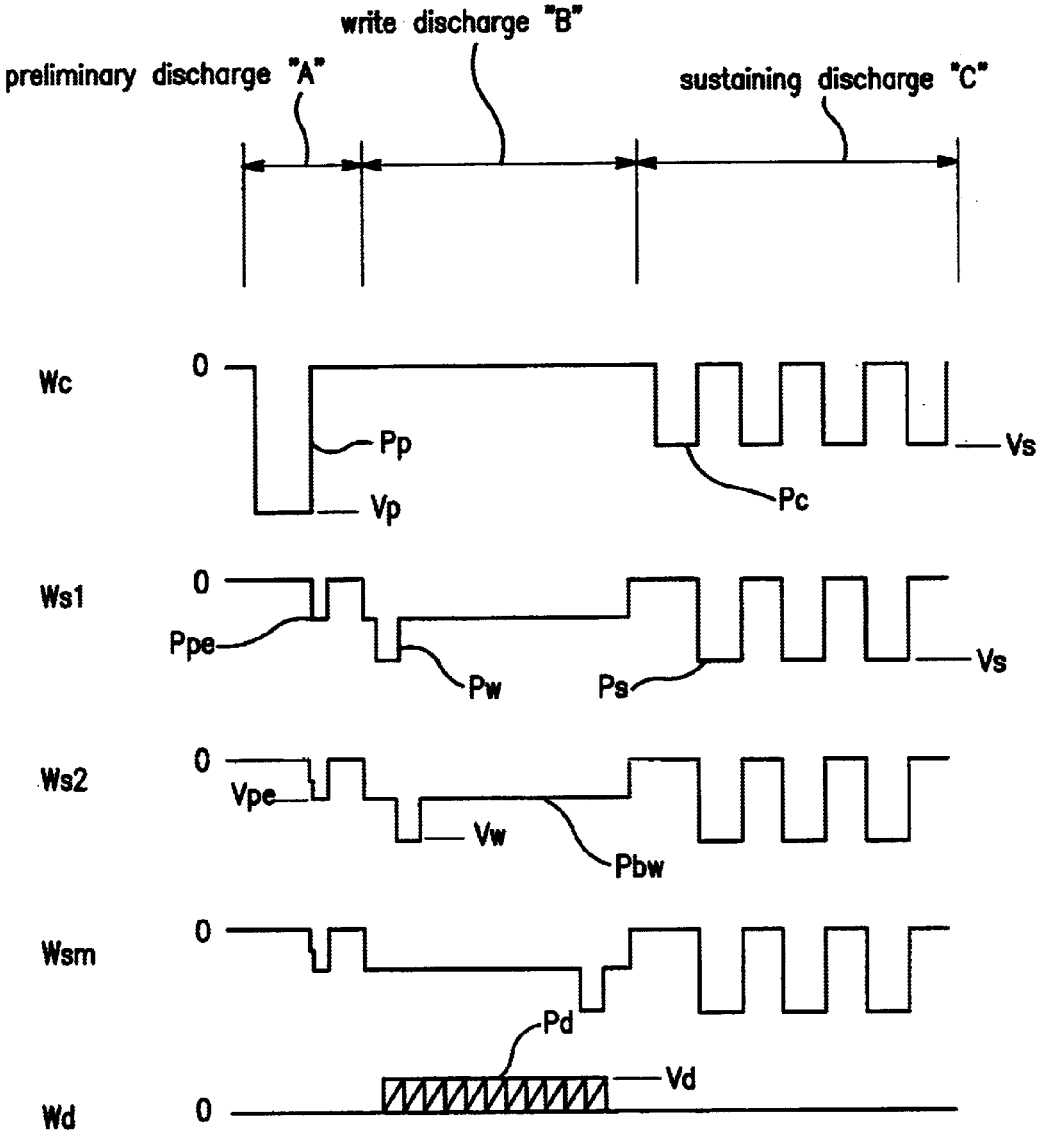
FIG. 6 is a diagram illustrative of waveforms of a sustaining electrode driving pulse, a scanning electrode driving pulse, and a data electrode driving pulse.

FIG. 6 is a diagram illustrative of waveforms of a sustaining electrode driving pulse Wc, a scanning electrode driving pulse Ws, and a data electrode driving pulse Wd. The sustaining electrode driving pulse Wc is supplied from the sustaining driver 22 and applied to the sustaining electrode Su1, - - - Sum. A scanning electrode driving pulse Ws1 is supplied from the scanning driver 21 and applied to the scanning electrode Sc1. A scanning electrode driving pulse Ws2 is supplied from the scanning driver 21 and applied to the scanning electrode Sc2. A scanning electrode driving pulse Wsm is supplied from the scanning driver 21 and applied to the scanning electrode Scm. A data electrode driving pulse Wd is supplied from the data driver 20 and applied to the data electrode D1, - - - Dn - - - .

One sub-field corresponds to a one driving cycle. The one sub-field comprises a preliminary discharge time period "A", a write discharge time period "B" following to the preliminary discharge time period "A", and a sustaining discharge time period "C" following to the write discharge time period "B". One frame comprises a plurality of the sub-fields, for example, six sub-fields in order to obtain an image display.

In the preliminary discharge time period "A", active particles and wall charges are formed in the discharge space 8 in order to obtain stable discharge characteristic in the next write discharge time period "B". Preliminary discharge pulses Pp are applied concurrently to the sustaining electrodes Su1, Su2, - - - Sum to cause preliminary discharges concurrently thereby forming wall charges before preliminary discharge erasing pulses Ppe are then applied concurrently to the scanning electrodes Sc1, Sc2, - - - Scm to erase charges, which may prevent the write discharge and sustaining discharge, in the wall charges. Namely, the preliminary discharge pulses Pp are applied concurrently to the sustaining electrodes Su1, Su2, - - - Sum to cause preliminary discharges concurrently in all of the display cells before the preliminary discharge erasing pulses Ppe are then applied concurrently to the scanning electrodes Sc1, Sc2, - - - Scm to cause erasing discharges to erase the wall charges as deposited by the preliminary discharge pulses Pp.

In the write discharge time period "B", scanning pulses Pw are sequentially applied to the scanning electrodes Sc1, Sc2, - - - Scm. Further, In synchronizing with the scanning pulses Pw, a data pulse is selectively applied to a selected one Di of the data electrodes D1, D2, - - - Dn, which is connected to a selected display cell on which a display is required, so that a write discharge is caused in the selected discharge cell.

In the sustaining discharge time period "C", sustain pulses Pc having a negative polarity are applied to the sustaining electrodes Su1, Su2, - - - Sum, and further sustain pulses Ps having a negative polarity with a delay in phase of 180 degrees from the above sustain pulses Pc are applied to the scanning electrodes Sc1, Sc2, - - - Scm.

Figure 7:
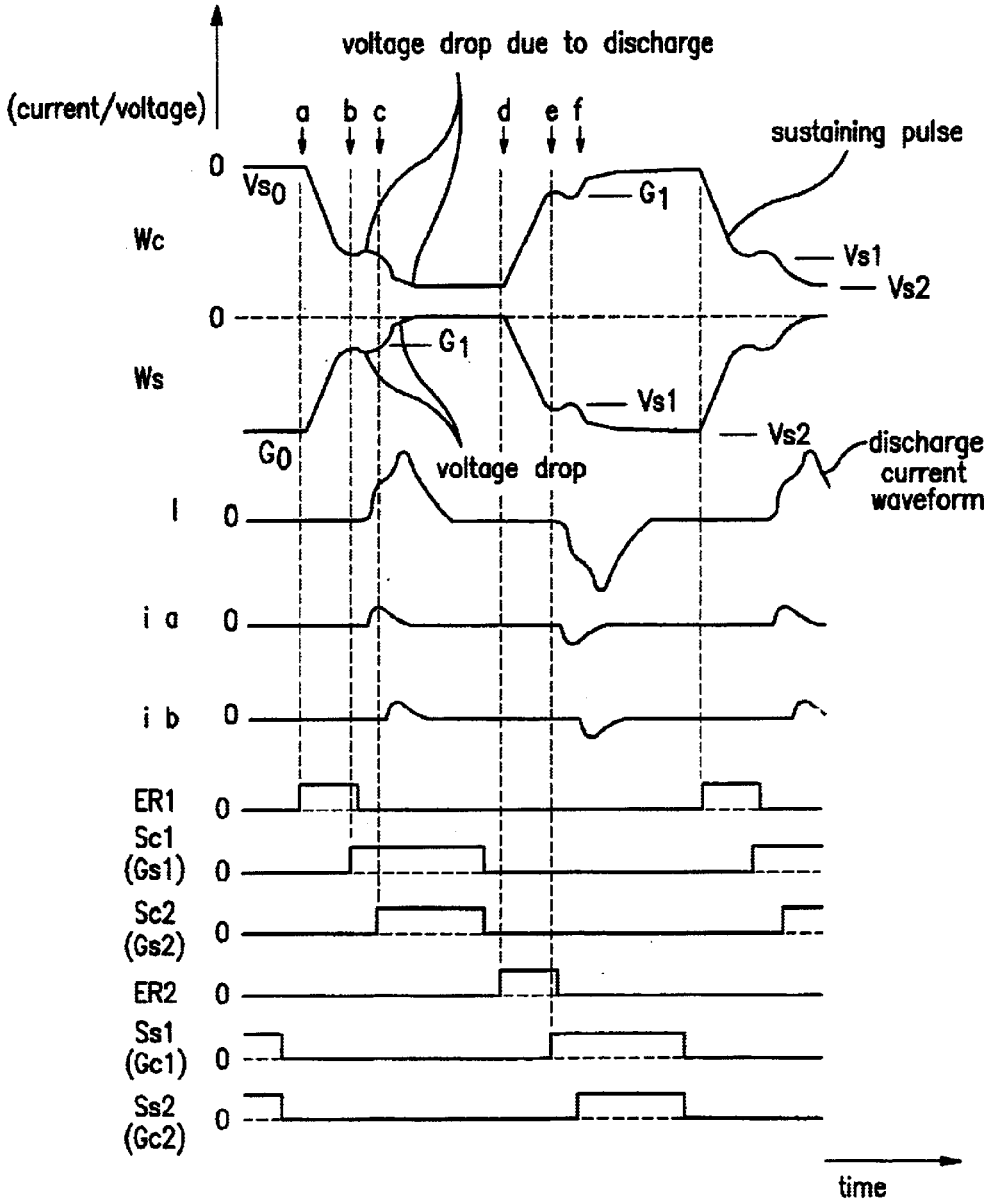
FIG. 7 is a timing chart illustrative of various signals used for practicing a novel sustaining pulse driving method of the plasma display panel in accordance with the present invention.

FIG. 7 is a timing chart illustrative of various signals used for practicing a novel sustaining pulse driving method of the plasma display panel in accordance with the present invention, where there are shown a waveform of a sustaining electrode driving pulse Wc to be applied to the sustaining electrodes 4 in the sustaining discharge time period "C", a waveform of a scanning electrode driving pulse Ws to be applied to the scanning electrodes 3, control signals for driving the sustaining electrode driving pulse Wc and the scanning electrode driving pulse Ws. A horizontal axis represents time, whilst a vertical axis represents voltage or current.

In accordance with the driver circuit for driving the plasma display panel 15, there are provided the address driver 20, the scanning driver 21 for applying the scanning electrode driving pulse Ws to the scanning electrodes 3, and the sustaining driver 22 for applying the sustaining electrode driving pulse Wc to the sustaining electrode 4. A first slope circuit (MOSFET T60) is operated in accordance with a control signal ER1 so as to supply a sustaining electrode driving pulse Wc which falls at a timing (a) as shown in FIG. 7 and also supply a scanning electrode driving pulse Ws which rises at the timing (a). At a timing (b), the potential of the sustaining pulse rises over a discharge initiation voltage whereby the discharge is initiated. Concurrently or immediately before it, a first sustaining discharge supply circuit is operated by use of a control signal Sc1 to drop a potential of the sustaining electrode driving pulse Wc to a voltage Vs1, and further a second sustaining discharge supply circuit is operated by use of a control signal Gs1 to rise a potential of the scanning electrode driving pulse Ws to a voltage G1. After a few hundreds nanoseconds from the initiation of the sustaining discharge, or at a timing (c), a third sustaining discharge supply circuit is operated in accordance with a control signal Sc2 to fall a potential of the sustaining electrode driving pulse Wc to a voltage Vs2, and further a fourth sustaining discharge supply circuit is operated by use of a control signal Gs2 to rise the potential of the scanning electrode driving pulse Ws to the ground voltage GND. A slope circuit (MOSFET T61) is operated in accordance with the control signal ER2 to cause the sustaining electrode driving pulse Wc to rise at a timing (d) whilst the scanning electrode driving pulse Ws falls at the timing (d). At a timing (e), the potential of the sustaining pulse rises over a discharge initiation voltage whereby the discharge is initiated. Concurrently or immediately before it, a fifth sustaining discharge supply circuit is operated by use of a control signal Gc1 to rise a potential of the sustaining electrode driving pulse Wc to a voltage G1, and further a sixth sustaining discharge supply circuit is operated by use of a control signal Ss1 to fall a potential of the scanning electrode driving pulse Ws to a voltage Vs1. After a few hundreds nanoseconds from the initiation of the sustaining discharge, or at a timing (f), a seventh sustaining discharge supply circuit is operated in accordance with a control signal Gc2 to rise a potential of the sustaining electrode driving pulse Wc to the ground level GND, and further an eighth sustaining discharge supply circuit is operated by use of a control signal Ss2 to fall the potential of the scanning electrode driving pulse Ws to a voltage Vs2. The above operations are repeated by the same times as the predetermined luminescence times whereby the sustaining discharge time period is ended.

Figure 8:
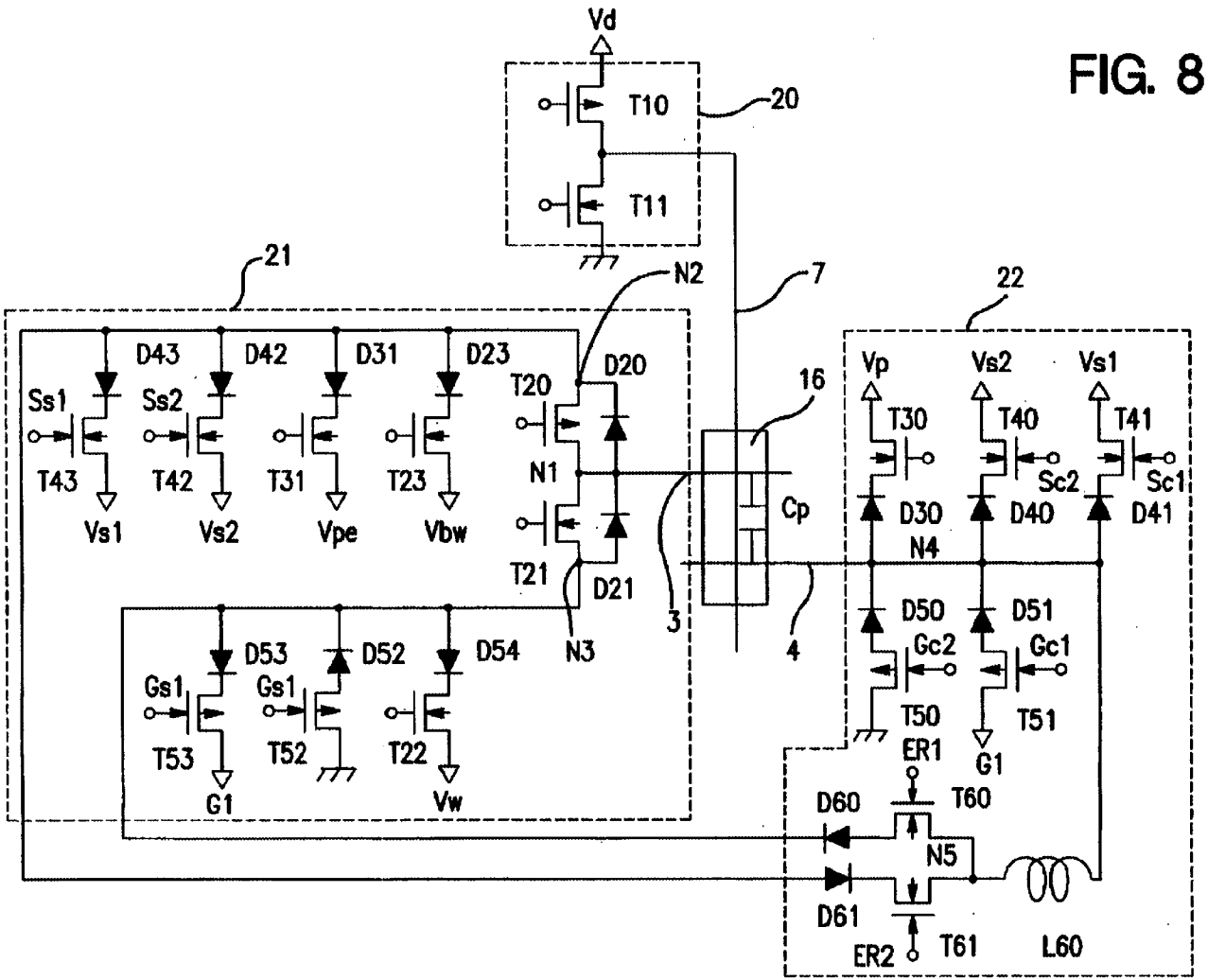
FIG. 8 is a circuit diagram illustrative of a circuit configuration of a driver circuit for driving a display cell of a plasma display panel in a first embodiment in accordance with the present invention.

FIG. 8 is a circuit diagram illustrative of a circuit configuration of a driver circuit for driving a display cell of a plasma display panel in a first embodiment in accordance with the present invention. The driver circuit is connected to a display cell 16. The driver circuit for driving the display cell 16 comprises an address driver 20, a scanning driver 21 and a sustaining driver 22. The address driver 20 is connected through a data electrode 7 to the display cell 16. The scanning driver 21 is also connected through a scanning electrode 3 to the display cell 16. The sustaining driver 22 is also connected through a sustaining electrode 4 to the display cell 16. The display cell 16 has a panel static capacitance between the scanning electrode 3 and the sustaining electrode 4. The address driver 20 comprises a complementary MOS circuit which comprises a series connection of an n-channel MOS field effect transistor T11 and a p-channel MOS field effect transistor T10 between a ground line and a high voltage line Vd, wherein the high voltage line is connected to the p-channel MOS field effect transistor T10, whilst the ground line is connected to the n-channel MOS field effect transistor T11. The data electrode 7 is connected to an intermediate point between the p-channel MOS field effect transistor T10 and the n-channel MOS field effect transistor T11.

The scanning driver 21 comprises nine diodes D20, D21, D23, D31, D42, D43, D52, D53 and D54 and six n-channel MOS field effect transistors T21, T22, T23, T31, T42 and T43 as well as three p-channel MOS field effect transistors T20, T52 and T53. The scanning electrode 3 is connected to a first node N1 of the scanning driver 21, The p-channel MOS field effect transistor T20 is connected in series between the first node N1 and a second node N2. The n-channel MOS field effect transistor T21 is connected in series between the first node N1 and a third node N3. The p-channel MOS field effect transistor T20 and the n-channel MOS field effect transistor T21 are connected in series between the second node N2 and the third node N3, and the first node as the intermediate point between the p-channel MOS field effect transistor 120 and the n-channel MOS field effect transistor T21 is connected to the scanning electrode 3. Two diodes D20 and D21 are connected in series between the second node N2 and the third node N3 in parallel to the series connection of the p-channel MOS field effect transistor T20 and the n-channel MOS field effect transistor T21. The diode D20 is connected between the first node N1 and the second node N2 in such a direction that the diode D20 allows a current from the first node N1 to the second node N2. The diode D21 is connected between the first node N1 and the third node N3 in such a direction that the diode D21 allows a current from the third node N3 to the fist node N1. The second node N2 is connected to the sustaining driver 22. The third node N3 is also connected to the sustaining driver 22. The diode D23 and the n-channel MOS field effect transistor T23 are connected in series between the second node N2 and a voltage line Vbw which is applied with a voltage level Vbw. The diode D23 is connected between the second node N2 and the n-channel MOS field effect transistor T23 in such a direction that the diode D23 allows a current from the second node N2 to the n-channel MOS field effect transistor T23. The n-channel MOS field effect transistor T23 connected between the diode D23 and the voltage line Vbw. The diode D31 and the n-channel MOS field effect transistor T31 are connected in series between the second node N2 and a voltage line Vpe which is applied with a voltage level Vpe. The diode D31 is connected between the second node N2 and the n-channel MOS field effect transistor T31 in such a direction that the diode D31 allows a current from the second node N2 to the n-channel MOS field effect transistor T31. The n-channel MOS field effect transistor T31 connected between the diode D31 and the voltage line Vpe. The diode D42 and the n-channel MOS field effect transistor T42 are connected in series between the second node N2 and a voltage line Vs2 which is applied with a voltage level Vs2. The diode D42 is connected between the second node N2 and the n-channel MOS field effect transistor T42 in such a direction that the diode D42 allows a current from the second node N2 to the n-channel MOS field effect transistor T42. The n-channel MOS field effect transistor T42 connected between the diode D42 and the voltage line Vs2. The diode D43 and the n-channel MOS field effect transistor T43 are connected in series between the second node N2 and a voltage line Vs1 which is applied with a voltage level Vs1. The diode D43 is connected between the second node N2 and the n-channel MOS field effect transistor T43 in such a direction that the diode D43 allows a current from the second node N2 to the n-channel MOS field effect transistor T43. The n-channel MOS field effect transistor T43 connected between the diode D43 and the voltage line Vs1. The diode D54 and the n-channel MOS field effect transistor T22 are connected in series between the third node N3 and a voltage line Vw which is applied with a voltage level Vw. The diode D54 is connected between the third node N3 and the n-channel MOS field effect transistor T22 in such a direction that the diode D54 allows a current from the third node N3 to the n-channel MOS field effect transistor T22. The n-channel MOS field effect transistor T22 connected between the diode D54 and the voltage line Vw. The diode D52 and the p-channel MOS field effect transistor T52 are connected in series between the third node N3 and a ground line which is applied with a ground voltage level. The diode D52 is connected between the third node N3 and the p-channel MOS field effect transistor T52 in such a direction that the diode D52 allows a current from the p-channel MOS field effect transistor T52 to the third node N3. The p-channel MOS field effect transistor T52 connected between the diode D52 and the ground line. The diode D53 and the p-channel MOS field effect transistor T53 are connected in series between the third node N3 and a voltage line G1 which is applied with a voltage level G1. The diode D53 is connected between the third node N3 and the p-channel MOS field effect transistor T53 in such a direction that the diode D53 allows a current from the p-channel MOS field effect transistor T53 to the third node N3. The p-channel MOS field effect transistor T53 connected between the diode D53 and the voltage line G1.

The sustaining driver 22 also comprises seven diodes D30, D40, D41, D50, D51, D60 and D61 and fifth n-channel MOS field effect transistors T30, T40, T41, T60 and T61 as well as two p-channel MOS field effect transistors T50 and T51. A fourth node N4 is connected to the sustaining electrode 4. The diode D30 and the n-channel MOS field effect transistor T30 are connected in series between the fourth node N4 and a voltage line Vp which is applied with a voltage level Vp. The diode D30 is connected between the fourth node N4 and the n-channel MOS field effect transistor T30 in such a direction that the diode D30 allows a current from the fourth node N4 to the n-channel MOS field effect transistor T30. The n-channel MOS field effect transistor T30 connected between the diode D30 and the voltage line Vp. The diode D40 and the n-channel MOS field effect transistor T40 are connected in series between the fourth node N4 and a voltage line Vs2 which is applied with a voltage level Vs2. The diode D40 is connected between the fourth node N4 and the n-channel MOS field effect transistor T40 in such a direction that the diode D40 allows a current from the fourth node N4 to the n-channel MOS field effect transistor T40. The n-channel MOS field effect transistor T40 connected between the diode D40 and the voltage line Vs2. The diode D41 and the n-channel MOS field effect transistor T41 are connected in series between the fourth node N4 and a voltage line Vs1 which is applied with a voltage level Vs1. The diode D41 is connected between the fourth node N4 and the n-channel MOS field effect transistor T41 in such a direction that the diode D41 allows a current from the fourth node N4 to the n-channel MOS field effect transistor T41. The n-channel MOS field effect transistor T41 connected between the diode D41 and the voltage line Vs1. The diode D50 and the p-channel MOS field effect transistor T50 are connected in series between the fourth node N4 and a ground line which is applied with a ground potential. The diode D50 is connected between the fourth node N4 and the p-channel MOS field effect transistor T50 in such a direction that the diode D50 allows a current from the p-channel MOS field effect transistor T50 to the fourth node N4. The p-channel MOS field effect transistor T50 connected between the diode D50 and the ground line. The diode D51 and the p-channel MOS field effect transistor T51 are connected in series between the fourth node N4 and a voltage line G1 which is applied with a voltage G1. The diode D51 is connected between the fourth node N4 and the p-channel MOS field effect transistor T51 in such a direction that the diode D51 allows a current from the p-channel MOS field effect transistor T51 to the fourth node N4. The p-channel MOS field effect transistor TS1 connected between the diode DS1 and the voltage line G1. The fourth node N4 is also connected through a reactance L60 to a fifth node N5. The diode D60 and the n-channel MOS field effect transistor T60 are connected in series between the fifth node N5 and the third node N3 of the scanning driver 21. The diode D60 is connected between the third node N3 and the n-channel MOS field effect transistor T60 in such a direction that the diode D60 allows a current from the n-channel MOS field effect transistor T60 to the third node N3. The n-channel MOS field effect transistor T60 connected between the diode D60 and the fifth node N5. The diode D61 and the n-channel MOS field effect transistor T61 are also connected in series between the fifth node N5 and the second node N2 of the scanning driver 21. The diode D61 is connected between the second node N2 and the n-channel MOS field effect transistor T61 in such a direction that the diode D61 allows a current from the second node N2 to the n-channel MOS field effect transistor T61. The n-channel MOS field effect transistor T61 connected between the diode D61 and the fifth node N5.

The above circuit operates as follows. In a preliminary discharge time period, the n-channel MOS field effect transistor T30 turns ON, so that the diode D30 causes the fourth node N4 and the sustaining electrode 4 to have the voltage level Vp, whereby a preliminary discharge pulse Pp is applied to the sustaining electrode 4. Concurrently, the p-channel MOS field effect transistor T52 is placed in the ON state, so that the series connection of the diodes D52 and D21 keeps the scanning electrode 3 in the ground potential.

Thereafter, the n-channel MOS field effect transistor T31 turns ON, so that series connection of the diodes D31 and D20 causes the second node N2 and the scanning electrode 3 to have the voltage level Vpe, whereby a preliminary discharge erasing pulse Ppe is applied to the scanning electrode 3. Concurrently, the p-channel MOS field effect transistor T50 is placed in the ON state, so that the diode D50 causes the sustaining electrode 4 to have the ground potential.

During the above preliminary discharge time period, the p-channel MOS field effect transistor T10 remains OFF state whilst the n-channel MOS field effect transistor T11 remains ON state, so that the data electrode 7 remains to have the ground level.

In a writing discharge time period, the n-channel MOS field effect transistor 173 turns ON, so that series connection of the diodes D23 and D20 causes the second node N2 and the scanning electrode 3 to have the voltage level Vbw. Concurrently, the p-channel MOS field effect transistor T50 is placed in the ON state, so that the diode D50 causes the sustaining electrode 4 to have the ground potential. Further, the n-channel MOS field effect transistor T22 is placed in the ON state. In these states, the n-channel MOS field effect transistor T21 is selectively switched into the ON state, so that the potential of the first node N1 and the scanning electrode 3 is dropped to the voltage level Vw, whereby the scanning pulse Pw is applied to the scanning electrode 3. For carrying out the writing discharge, in response to this scanning pulse Pw, the p-channel MOS field effect transistor T10 turns ON whilst the n-channel MOS field effect transistor T11 turns OFF, so that the data electrode 7 becomes to have the voltage level Vd, whereby the data pulse is applied to the data electrode 7.

Operations of the above circuit of FIG. 8 will be described with reference to again to FIG. 7. At a timing (a) of FIG. 7, a control signal ER1 becomes high level. The n-channel MOS field effect transistor T60 turns ON, so that charges accumulated in the panel static capacitance Cp are caused to flow through the sustaining electrode 4, the reactance L60, the n-channel MOS field effect transistor T60, and the diodes D60 and D21 to the first node N1 and the scanning electrode 3, whereby a resonance phenomenon is caused to charge opposite-polarity charges to the panel capacitance Cp. As a result, the scanning electrode 3 is made into the potential G0 and the sustaining electrode 4 is made into the potential Vs0.

Thereafter, in order to supply the sustaining discharge current, at a timing (b) of FIG. 7, the control signal Sc1 becomes high level. The n-channel MOS field effect transistor T41 turns ON, so that the potential of the fourth node N4 and the sustaining electrode 4 is dropped into the voltage level Vs1. Concurrently, the control signal Gs1 becomes high level. The p-channel MOS field effect transistor T53 turns ON, so that the potential of the first node N1 and the scanning electrode 3 is risen up to the voltage level G1. At the same time or immediately thereafter, the discharge cell 16 shows a sustaining discharge, for which purpose the sustaining discharge current is supplied from the individual powers for supplying the voltage levels G1 and Vs1.

At a timing (c) of FIG. 7, the control signal Sc2 becomes high level. The n-channel MOS field effect transistor T40 turns ON, so that the potential of the fourth node N4 and the sustaining electrode 4 is further dropped into the voltage level Vs2 which is lower than the previous voltage level Vs1. Concurrently, the control signal Gs2 becomes high level. The p-channel MOS field effect transistor T52 turns ON, so that the potential of the first node N1 and the scanning electrode 3 is further risen up to the ground level GND which is higher than the previous voltage level G1. At this time, the discharge cell 16 is on showing a sustaining discharge, for which reason the sustaining discharge currents supplying routes are changed into the ground through the n-channel MOS field effect transistor T40 and the p-channel MOS field effect transistor T52 as well as from the power source supplying the voltage level Vs2. It is preferable that the timing (c) is delayed by a few hundred nanoseconds, for example, about 100–300 nanoseconds from the initiation of the sustaining discharge.

At a timing (d) of FIG. 7, a control signal ER2 becomes high level. The n-channel MOS field effect transistor T61 turns ON, so that charges accumulated in the panel static capacitance Cp are caused to flow through the scanning electrode 3, the diodes D20 and D61, the n-channel MOS field effect transistor T61 and the reactance L60 to the fourth node N4 and the sustaining electrode 4, whereby a resonance phenomenon is caused to charge opposite-polarity charges to the panel capacitance Cp. As a result, the sustaining electrode 4 is risen up to the potential G0 and the scanning electrode 3 is dropped to the potential Vs0.

Thereafter, in order to supply the sustaining discharge current, at a timing (e) of FIG. 7, the control signal Ss1 becomes high level. The n-channel MOS field effect transistor T43 turns ON, so that the potential of the first node N1 and the scanning electrode 3 is dropped into the voltage level Vs1. Concurrently, the control signal Gc1 becomes high level. The p-channel MOS field effect transistor T51 turns ON, so that the potential of the fourth node N4 and the sustaining electrode 4 is risen up to the voltage level G1. At the same time or immediately thereafter, the discharge cell 16 shows a sustaining discharge, for which purpose the sustaining discharge current is supplied from the individual powers for supplying the voltage levels G1 and Vs1 through the n-channel MOS field effect transistor T43 and the p-channel MOS field effect transistor T51 respectively, At a timing (f) of FIG. 7, the control signal Ss2 becomes high level. The n-channel MOS field effect transistor T42 turns ON, so that the potential of the first node N1 and the scanning electrode 3 is further dropped into the voltage level Vs2 which is lower than the previous voltage level Vs1. Concurrently, the control signal Gc2 becomes high level. The p-channel MOS field effect transistor T50 turns ON, so that the potential of the fourth node N4 and the sustaining electrode 4 is further risen up to the ground level GND which is higher than the previous voltage level G1. At this time, the discharge cell 16 is on showing a sustaining discharge, for which reason the sustaining discharge currents supplying routes are changed into the ground through the n-channel MOS field effect transistor T42 and the p-channel MOS field effect transistor T50 as well as from the power source supplying the voltage level Vs2 to supply the sustaining discharge current during the sustaining discharge operation. It is preferable that the timing (f) is delayed by a few hundred nanoseconds, for example, about 100–300 nanoseconds from the initiation of the sustaining discharge.

With reference back to FIG. 7, the waveforms of the sustaining electrode driving pulses Wc and the sustaining discharge current I in the sustaining discharge time period are shown. A current for charging the static capacitance Cp of the discharge cell is ignored. The sustaining discharge current corresponds to a discharge current due to a discharge from the sealed gas. A plurality of the display cells 16 show sustaining discharges. A sustaining discharge current I is a current flowing on one electrode. A sustaining discharge current ia and a sustaining discharge current ib are currents flowing on individual display cells 16.

The sustaining discharge appears between the timings (b) and (c). In the time period between the timings (b) and (c), an applied voltage is lowered than after the timing (c), for which reason in the time period between the timings (b) and (c), the sustaining discharge appears in the display cells 16 which have lower discharge threshold voltages. The discharge current is as the sustaining discharge current ia. After the timing (c), the applied voltage level is risen to cause the currents as the sustaining discharge current ib in the display cells 16 which did not show the discharge between the timings (b) and (c).

If a relatively small number of the display cells 16 shows the sustaining discharge, appearance of the sustaining discharge tends to be concentrated into an early time after the sustaining voltage is applied. The sustaining discharge current for each electrode is made small whereby the voltage drop due to the electrode resistance is also made small, and a sufficient driving voltage can be applied to the individual display cell 16.

Figure 9:
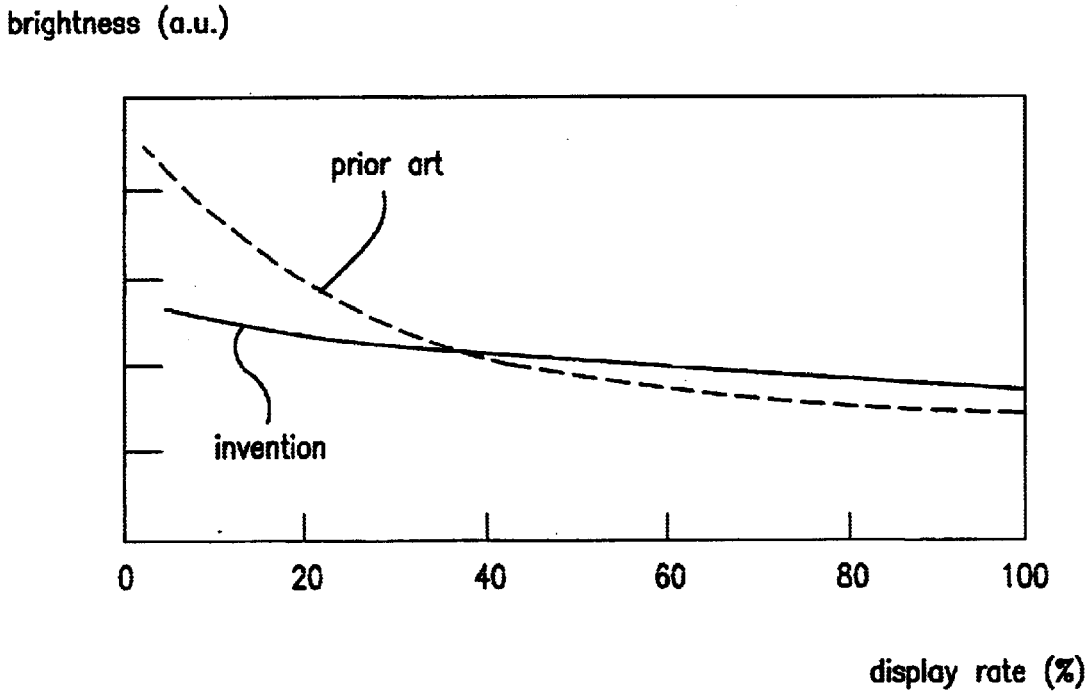
FIG. 9 is a diagram illustrative of variations in brightness over the display rate in the conventional and novel methods.

As described above, in accordance with the first embodiment, the sustaining pulse voltage level in the initial time period is small to control the supply current to the display cell 16 in order to prevent an excess increase in intensity of the sustaining discharge or an excess increase in intensity of the luminescence. If a large number of the display cells 16 show sustaining discharges, in the time period between the timings (b) and (c), the discharge current is made small, and the time period between the timings (b) and (c) so adjusted as to cause the sustaining discharge to continue after the timing (c). After the timing (c), the driving voltage is increased to rise the intensity of the sustaining discharge whereby the intensity of the luminescence is recovered. As a result, almost the same brightness as when a small number of the discharge cells show the sustaining discharge can be obtained. FIG. 9 is a diagram illustrative of variations in brightness over the display rate in the conventional and novel methods. In accordance with the novel method, the variation in brightness of the display panel versus the display rate or the number of the sustaining discharge cells is smaller than the conventional method. Independently from the display load, the sustaining discharge driving margin is stable and the luminescence intensity by the sustaining discharge is almost constant.

Second Embodiment

A second embodiment according to the present invention will be described in detail with reference to the drawings.

Figure 10:
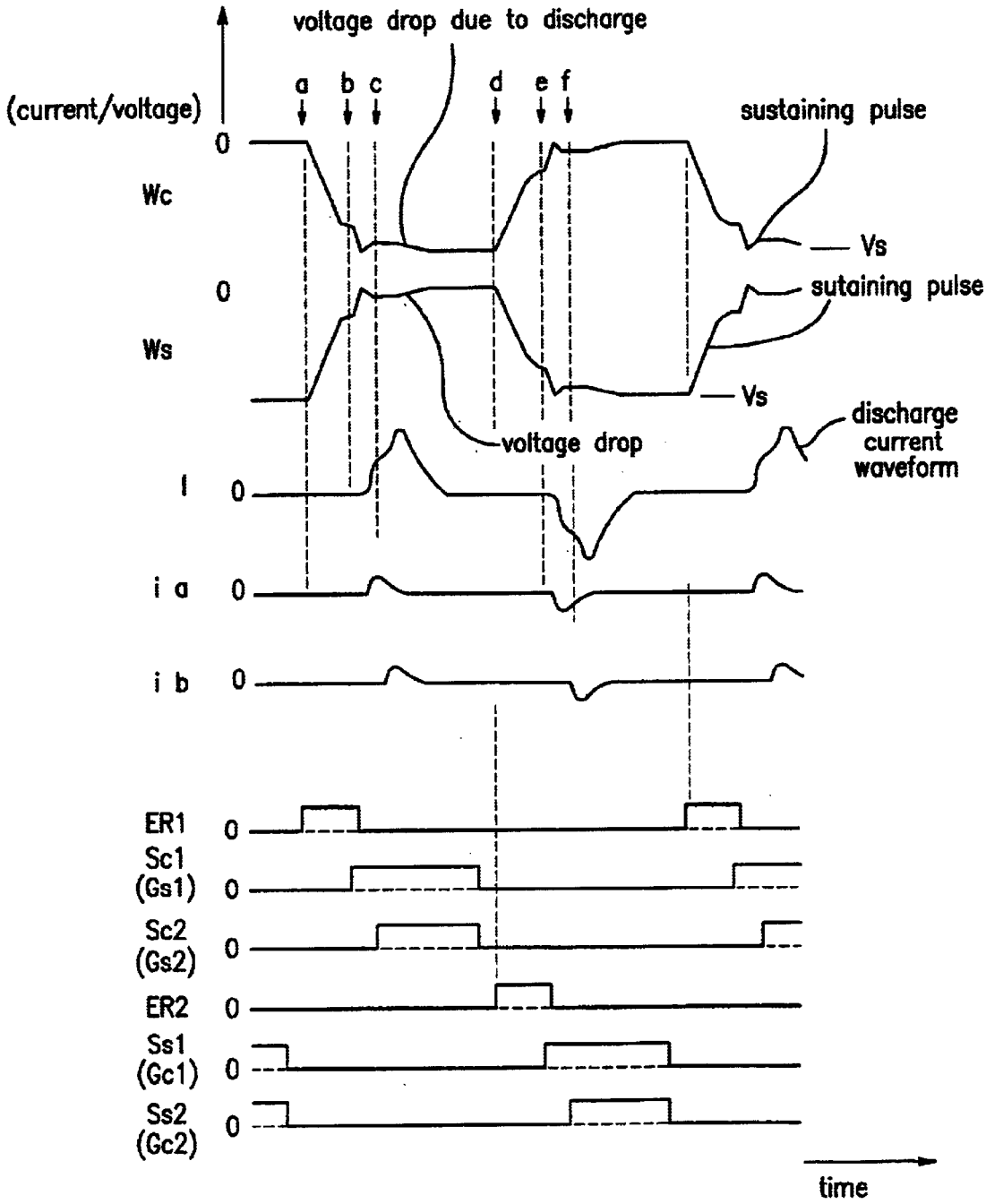
FIG. 10 is a timing chart illustrative of various signals used for practicing a novel sustaining pulse driving method of the plasma display panel in accordance with the present invention.

FIG. 10 is a timing charge illustrative of various signals used for practicing a novel sustaining pulse driving method of the plasma display panel in accordance with the present invention, where there are shown a waveform of a sustaining electrode driving pulse Wc to be applied to the sustaining electrodes 4 in the sustaining discharge time period "C", a waveform of a scanning electrode driving pulse Ws to be applied to the scanning electrodes 3, control signals for driving the sustaining electrode driving pulse Wc and the scanning electrode driving pulse Ws. A horizontal axis represents time, whilst a vertical axis represents a voltage or current.

In accordance with the driver circuit for driving the plasma display panel 15, there are provided the address driver 20, the scanning driver 21 for applying the scanning electrode driving pulse Ws to the scanning electrodes 3, and the sustaining driver 22 for applying the sustaining electrode driving pulse Wc to the sustaining electrode 4. A first slope circuit (MOSFET T60) is operated in accordance with a control signal ER1 so as to supply a sustaining electrode driving pulse Wc which falls at a timing (a) as shown in FIG. 10 and also supply a scanning electrode driving pulse Ws which rises at the timing (a). At a timing (b), the potential of the sustaining pulses rises over a discharge initiation voltage whereby the discharge is initiated. Concurrently or immediately before it, a first sustaining discharge supply circuit is operated by use of a control signal Sc1 to drop a potential of the sustaining electrode driving pulse Wc to a voltage Vs, and further a second sustaining discharge supply circuit is operated by use of a control signal Gs1 to rise a potential of the scanning electrode driving pulse Ws to the ground voltage GND. After a few hundreds nanoseconds from the initiation of the sustaining discharge, or at a timing (c), a third sustaining discharge supply circuit is operated in accordance with a control signal Sc2, and further a fourth sustaining discharge supply circuit is operated by use of a control signal Gs2 to place the first to fourth sustaining discharge supply circuits into operable states. A slope circuit is operated in accordance with the control signal ER2 to cause the sustaining electrode driving pulse Wc to rise at a timing (d) whilst the scanning electrode driving pulse Ws falls at the timing (d). At a timing (e), the potential of the sustaining pulse rises over a discharge initiation voltage whereby the discharge is initiated. Concurrently or immediately before it, a fifth sustaining discharge supply circuit is operated by use of a control signal Gc1 to rise a potential of the sustaining electrode driving pulse Wc to the ground voltage GND, and further a sixth sustaining discharge supply circuit is operated by use of a control signal Ss1 to fall a potential of the scanning electrode driving pulse Ws to a voltage Vs. After a few hundreds nanoseconds from the initiation of the sustaining discharge, or at a timing (f), a seventh sustaining discharge supply circuit is operated in accordance with a control signal Gc2, and further an eighth sustaining discharge supply circuit is operated by use of a control signal Ss2 to place the fifth to eighth sustaining discharge supply circuits into operable states. The above operations are repeated by the same times as the predetermined luminescence times whereby the sustaining discharge time period is ended.

Figure 11:
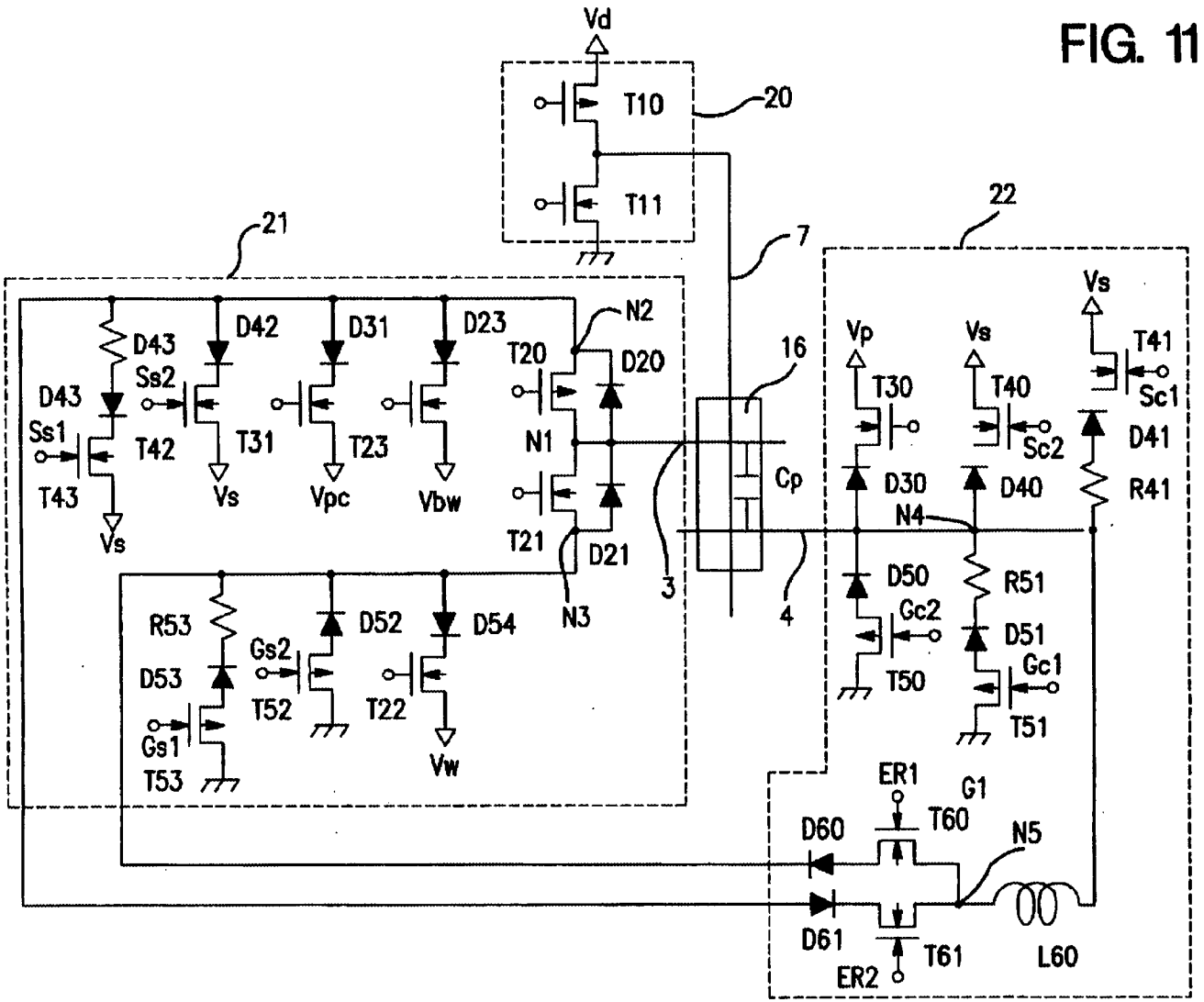
FIG. 11 is a circuit diagram illustrative of a circuit configuration of a driver circuit for driving a display cell of a plasma display panel in a second embodiment in accordance with the present invention.

FIG. 11 is a circuit diagram illustrative of a circuit configuration of a driver circuit for driving a display cell of a plasma display panel in a second embodiment in accordance with the present invention. The driver circuit is connected to a display cell 16. The driver circuit for driving the display cell 16 comprises an address driver 20, a scanning driver 21 and a sustaining driver 22. The address driver 20 is connected through a data electrode 7 to the display cell 16. The scanning driver 21 is also connected through a scanning electrode 3 to the display cell 16. The sustaining driver 22 is also connected through a sustaining electrode 4 to the display cell 16. The display cell 16 has a panel static capacitance between the scanning electrode 3 and the sustaining electrode 4. The address driver 20 comprises a complementary MOS circuit which comprises a series connection of an n-channel MOS field effect transistor T11 and a p-channel MOS field effect transistor T10 between a ground line and a high voltage line Vd, wherein the high voltage line is connected to the p-channel MOS field effect transistor T10, whilst the ground line is connected to the n-channel MOS field effect transistor T11. The data electrode 7 is connected to an intermediate point between the p-channel MOS field effect transistor T10 and the n-channel MOS field effect transistor T11.

The scanning driver 21 comprises nine diodes D20, D21, D23, D31, D42, D43, D52, D53 and D54 and six n-channel MOS field effect transistors T21, T22, T23, T31, T42 and T43 as well as three p-channel MOS field effect transistors T20, T52 and T53 and a single resistance R53. The scanning electrode 3 is connected to a first node N1 of the scanning driver 21. The p-channel MOS field effect transistor T20 is connected in series between the first node N1 and a second node N2. The n-channel MOS field effect transistor T21 is connected in series between the first node N1 and a third node N3. The p-channel MOS field effect transistor T20 and the n-channel MOS field effect transistor T21 are connected in series between the second node N2 and the third node N3, and the first node as the intermediate point between the p-channel MOS field effect transistor T20 and the n-channel MOS field effect transistor T21 is connected to the scanning electrode 3. Two diodes D20 and D21 are connected in series between the second node N2 and the third node N3 in parallel to the series connection of the p-channel MOS field effect transistor T20 and the n-channel MOS field effect transistor T21. The diode D20 is connected between the first node N1 and the second node N2 in such a direction that the diode D20 allows a current from the first node N1 to the second node N2. The diode D21 is connected between the first node N1 and the third node N3 in such a direction that the diode D21 allows a current from the third node N3 to the first node N1. The second node N2 is connected to the sustaining driver 22. The third node N3 is also connected to the sustaining driver 22. The diode D23 and the n-channel MOS field effect transistor T23 are connected in series between the second node N2 and a voltage line Vbw which is applied with a voltage level Vbw. The diode D23 is connected between the second node N2 and the n-channel MOS field effect transistor T23 in such a direction that the diode D23 allows a current from the second node N2 to the n-channel MOS field effect transistor T23. The n-channel MOS field effect transistor T23 connected between the diode D23 and the voltage line Vbw. The diode D31 and the n-channel MOS field effect transistor T31 are connected in series between the second node N2 and a voltage line Vpe which is applied with a voltage level Vpe. The diode D31 is connected between the second node N2 and the n-channel MOS field effect transistor T31 in such a direction that the diode D31 allows a current from the second node N2 to the n-channel MOS field effect transistor T31. The n-channel MOS field effect transistor T31 connected between the diode D31 and the voltage line Vpe. The diode D42 and the n-channel MOS field effect transistor T42 are connected in series between the second node N2 and a voltage line Vs which is applied with a voltage level Vs. The diode D42 is connected between the second node N2 and the n-channel MOS field effect transistor T42 in such a direction that the diode D42 allows a current from the second node N2 to the n-channel MOS field effect transistor T42. The n-channel MOS field effect transistor T42 connected between the diode D42 and the voltage line Vs. The diode D43 and the n-channel MOS field effect transistor T43 are connected in series between the second node N2 and a voltage line Vs which is applied with a voltage level Vs. The diode D43 is connected between the second node N2 and the n-channel MOS field effect transistor T43 in such a direction that the diode D43 allows a current from the second node N2 to the n-channel MOS field effect transistor T43. The n-channel MOS field effect transistor T43 connected between the diode D43 and the voltage line Vs. The diode D54 and the n-channel MOS field effect transistor T22 are connected in series between the third node N3 and a voltage line Vw which is applied with a voltage level Vw. The diode D54 is connected between the third node N3 and the n-channel MOS field effect transistor T22 in such a direction that the diode D54 allows a current from the third node N3 to the n-channel MOS field effect transistor T22. The n-channel MOS field effect transistor T22 connected between the diode D54 and the voltage line Vw. The diode D52 and the p-channel MOS field effect transistor T52 are connected in series between the third node N3 and a ground line which is applied with a ground voltage level. The diode D52 is connected between the third node N3 and the p-channel MOS field effect transistor T52 in such a direction that the diode D52 allows a current from the p-channel MOS field effect transistor T52 to the third node N3. The p-channel MOS field effect transistor T52 connected between the diode D52 and the ground line. The resistance R53, the diode D53 and the p-channel MOS field effect transistor T53 are connected in series between the third node N3 and a ground line which is applied with a ground level. The resistance R53 is connected between the diode D53 and the third node N3. The diode D53 is connected between the resistance R53 and the p-channel MOS field effect transistor T53 in such a direction that the diode D53 allows a current from the p-channel MOS field effect transistor T53 to the resistance R53. The p-channel MOS field effect transistor T53 connected between the diode D53 and the ground line.

The sustaining driver 22 also comprises seven diodes D30, D40, D41, D50, D51, D60 and D61 and fifth n-channel MOS field effect transistors T30, T40, T41, T60 and T61 as well as two p-channel MOS field effect transistors T50 and T51. A fourth node N4 is connected to the sustaining electrode 4. The diode D30 and the n-channel MOS field effect transistor T30 are connected in series between the fourth node N4 and a voltage line Vp which is applied with a voltage level Vp. The diode D30 is connected between the fourth node N4 and the n-channel MOS field effect transistor T30 in such a direction that the diode D30 allows a current from the fourth node N4 to the n-channel MOS field effect transistor T30. The n-channel MOS field effect transistor T30 connected between the diode D30 and the voltage line Vp. The diode D40 and the n-channel MOS field effect transistor T40 are connected in series between the fourth node N4 and a voltage line Vs2 which is applied with a voltage level Vs2. The diode D40 is connected between the fourth node N4 and the n-channel MOS field effect transistor T40 in such a direction that the diode D40 allows a current from the fourth node N4 to the n-channel MOS field effect transistor T40. The n-channel MOS field effect transistor T40 connected between the diode D40 and the voltage line Vs2. The diode D41 and the n-channel MOS field effect transistor T41 are connected in series between the fourth node N4 and a voltage line Vs1 which is applied with a voltage level Vs1. The diode D41 is connected between the fourth node N4 and the n-channel MOS field effect transistor T41 in such a direction that the diode D41 allows a current from the fourth node N4 to the n-channel MOS field effect transistor T41. The n-channel MOS field effect transistor T41 connected between the diode D41 and the voltage line Vs1. The diode D50 and the p-channel MOS field effect transistor T50 are connected in series between the fourth node N4 and a ground line which is applied with a ground potential. The diode D50 is connected between the fourth node N4 and the p-channel MOS field effect transistor T50 in such a direction that the diode D50 allows a current from the p-channel MOS field effect transistor T50 to the fourth node N4. The p-channel MOS field effect transistor T50 connected between the diode D50 and the ground line The diode D51 and the p-channel MOS field effect transistor T51 are connected in series between the fourth node N4 and a ground line which is applied with a ground voltage. The diode D51 is connected between the fourth node N4 and the p-channel MOS field effect transistor T51 in such a direction that the diode D51 allows a current from the p-channel MOS field effect transistor T51 to the fourth node N4. The p-channel MOS field effect transistor T51 connected between the diode D51 and the ground line. The fourth node N4 is also connected through a reactance L60 to a fifth node N5. The diode D60 and the n-channel MOS field effect transistor T60 are connected in series between the fifth node N5 and the third node N3 of the scanning driver 21. The diode D60 is connected between the third node N3 and the n-channel MOS field effect transistor T60 in such a direction that the diode D60 allows a current from the n-channel MOS field effect transistor T60 to the third node N3. The n-channel MOS field effect transistor T60 connected between the diode D60 and the fifth node N5. The diode D61 and the n-channel MOS field effect transistor T61 are also connected in series between the fifth node N5 and the second node N2 of the scanning driver 21. The diode D61 is connected between the second node N2 and the n-channel MOS field effect transistor T61 in such a direction that the diode D61 allows a current from the second node N2 to the n-channel MOS field effect transistor T61. The n-channel MOS field effect transistor T61 connected between the diode D61 and the fifth node N5.

The above circuit operates as follows. In a preliminary discharge time period, the n-channel MOS field effect transistor T30 turns ON, so that the diode D30 causes the fourth node N4 and the sustaining electrode 4 to have the voltage level Vp, whereby a preliminary discharge pulse Pp is applied to the sustaining electrode 4. Concurrently, the p-channel MOS field effect transistor T52 is placed in the ON state, so that the series connection of the diodes D52 and D21 keeps the scanning electrode 3 in the ground potential.

Thereafter, the n-channel MOS field effect transistor T31 turns ON, so that series connection of the diodes D31 and D20 causes the second node N2 and the scanning electrode 3 to have the voltage level Vpe, whereby a preliminary discharge erasing pulse Ppe is applied to the scanning electrode 3. Concurrently, the p-channel MOS field effect transistor T50 is placed in the ON state, so that the diode D50 causes the sustaining electrode 4 to have the ground potential.

During the above preliminary discharge time period, the p-channel MOS field effect transistor T10 remains OFF state whilst the n-channel MOS field effect transistor T11 remains ON state, so that the data electrode 7 remains to have the ground level.

In a writing discharge time period, the n-channel MOS field effect transistor T23 turns ON, so that series connection of the diodes D23 and D20 causes the second node N2 and the scanning electrode 3 to have the voltage level Vbw, Concurrently, the p-channel MOS field effect transistor T50 is placed in the ON state, so that the diode D50 causes the sustaining electrode 4 to have the ground potential. Further, the n-channel MOS field effect transistor T22 is placed in the ON state. In these states, the n-channel MOS field effect transistor T21 is selectively switched into the ON state, so that the potential of the first node N1 and the scanning electrode 3 is dropped to the voltage level Vw, whereby the scanning pulse Pw is applied to the scanning electrode 3. For carrying out the writing discharge, in response to this scanning pulse Pw, the p-channel MOS field effect transistor T10 turns ON whilst the n-channel MOS field effect transistor T11 turns OFF, so that the data electrode 7 becomes to have the voltage level Vd, whereby the data pulse is applied to the data electrode 7.

Operations of the above circuit of FIG. 11 will be described with reference to again to FIG. 10. At a timing (a) of FIG. 10, a control signal ER1 becomes high level. The n-channel MOS field effect transistor T60 turns ON, so that charges accumulated in the panel static capacitance Cp are caused to flow through the sustaining electrode 4, the reactance L60, the n-channel MOS field effect transistor T60, and the diodes D60 and D21 to the first node N1 and the scanning electrode 3, whereby a resonance phenomenon is caused to charge opposite-polarity charges to the panel capacitance Cp. As a result, the scanning electrode 3 is made into the potential G0 and the sustaining electrode 4 is made into the potential Vs0.

Thereafter, in order to supply the sustaining discharge current, at a timing (b) of FIG. 10, the control signal Sc1 becomes high level. The n-channel MOS field effect transistor T41 turns ON, so that the potential of the fourth node N4 and the sustaining electrode 4 is dropped into the voltage level Vs. Concurrently, the control signal Gs1 becomes high level. The p-channel MOS field effect transistor T53 turns ON, so that the potential of the first node N1 and the scanning electrode 3 is risen up to the ground level GND. At the same time or immediately thereafter, the discharge cell 16 shows a sustaining discharge, for which purpose the sustaining discharge current is supplied from the individual powers for supplying the ground level GND and the voltage level Vs through the n-channel MOS field effect transistor T41 and the p-channel MOS field effect transistor T53 respectively.

At a timing (c) of FIG. 10, the control signal Sc2 becomes high level. The n-channel MOS field effect transistor T40 turns ON, so that the number of the driver circuitry for keeping the potential of the fourth node N4 and the sustaining electrode 4 at the voltage level Vs is increased, whereby a capability of supplying the sustaining discharge current from the power source supplying the voltage level Vs is increased. Concurrently, the control signal Gs2 becomes high level. The p-channel MOS field effect transistor T52 turns ON, so that the number of the driver circuitry for keeping the potential of the first node N1 and the scanning electrode 3 at the ground level GND whereby a capability of supplying the sustaining discharge current from the ground supplying the ground voltage level GND is increased. It is preferable that the timing (c) is delayed by a few hundred nanoseconds, for example, about 100–300 nanoseconds from the initiation of the sustaining discharge.

At a timing (d) of FIG 10, a control signal ER2 becomes high level. The n-channel MOS field effect transistor T61 turns ON, so that charges accumulated in the panel static capacitance Cp are caused to flow through the scanning electrode 3, the diodes D20 and D61, the n-channel MOS field effect transistor T61 and the reactance L60 to the fourth node N4 and the sustaining electrode 4, whereby a resonance phenomenon is caused to charge opposite-polarity charges to the panel capacitance Cp. As a result, the sustaining electrode 4 is risen up to the potential G0 and the scanning electrode 3 is dropped to the potential Vs0.

At a timing (e) of FIG. 10, the control signal Ss1 becomes high level. The n-channel MOS field effect transistor T43 turns ON, so that the potential of the first node N1 and the scanning electrode 3 is dropped into the voltage level Vs. Concurrently, the control signal Gc1 becomes high level. The p-channel MOS field effect transistor T51 turns ON, so that the potential of the fourth node N4 and the sustaining electrode 4 is risen up to the ground level GND. At the same time or immediately thereafter, the discharge cell 16 shows a sustaining discharge, for which purpose the sustaining discharge current is supplied from the ground for supplying the ground voltage level GND and the power source supplying the voltage level Vs through the n-channel MOS field effect transistor T43 and the p-channel MOS field effect transistor T51 respectively.

At a timing (f) of FIG. 10, the control signal Ss2 becomes high level. The n-channel MOS field effect transistor T42 turns ON, so that the number of the driver circuitry for keeping the potential of the first node N1 and the scanning electrode 3 at the voltage level Vs, whereby a capability of supplying the sustaining discharge current from the power source supplying the voltage level Vs is increased. Concurrently, the control signal Gc2 becomes high level. The p-channel MOS field effect transistor T50 turns ON, so that the number of the driver circuitry for keeping the potential of the fourth node N4 and the sustaining electrode 4 at the ground level GND, whereby a capability of supplying the sustaining discharge current from the ground is increased. At this time, the discharge cell 16 is on showing a sustaining discharge. It is preferable that the timing (f) is delayed by a few hundred nanoseconds, for example, about 100–300 nanoseconds from the initiation of the sustaining discharge.

As shown in FIG. 11, the resistances R41, R43, R51, and R53 are connected in series through the diodes D41, D43, D51 and D53 to the MOS field effect transistors T41, T43, T51 and T53 respectively which are operated immediately after the sustaining pulse is varied, so that the resistances R41, R43, R51, and R53 prevent excess sustaining discharge currents.

As shown in FIG. 11, the resistance is connected to the output side of the first sustaining clamp circuit to prevent a rapid growth of the sustaining discharge and to allow the sustaining discharge to continue at a second sustaining clamp voltage, so that the brightness is independent from the display load. Namely, the current restriction resistances are provided to the first sustaining clamp circuit for preventing the excess sustaining discharge current on the display cell 16 if the luminescent load is small, so that the sustaining discharge is made weak to reduce the discharge current, whereby the luminescence brightness is suppressed.

If the luminescence load is large, the discharge current is divided into the large number of the display cells 16. Notwithstanding, the current restriction resistance are provided to reduce the sustaining discharge current for each of the display cells 16 so as to prevent insufficient supply of the current. For each of the display cells 16, it is possible to supply the same discharge current as when the luminescence load is small and also keep the brightness similarly to when the luminescence load is small. As shown in FIG. 9, the variation in brightness versus the variation in the luminescence load may be reduced.

At the first sustaining clamp timing, the sustaining discharge current may be supplied from the MOS field effect transistors 41 and 43. At the second sustaining clamp timing, the sustaining discharge current may be supplied from the MOS field effect transistors 40 and 42.

In accordance with the second embodiment, in addition to the effects of the first embodiments, there can be obtained an effect to stabilize the sustaining discharge driving margin independently from the display load and also to keep constant the luminescence intensity by the sustaining discharge.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A method of driving a sustaining pulse for a plasma display panel, the method including the steps of:

applying a sustaining discharge for each sustaining pulse;

causing a step-by-step increase in current supplying ability of each said sustaining discharge over at least three steps; and controlling respective sustaining periods for each step-by-step increase in said current supplying ability, wherein said controlling step is accomplished so that a time between a next to last step and a last step of said at least three steps is in the range of 100 nanoseconds to 300 nanoseconds.

2. The method as claimed in claim 1, wherein said current supplying ability on a second of said at least three steps causes part of all display cells to generate a sustaining discharge.

3. A circuit for driving sustaining pulses for a plasma display panel, said circuit comprising:

a first sustaining discharge supply circuit for setting potentials of sustaining electrodes at a first sustaining discharge potential;

a second sustaining discharge supply circuit for setting potentials of scanning electrodes at a second sustaining discharge potential which is higher than said first sustaining discharge potential;

a third sustaining discharge supply circuit for setting said potentials of said sustaining electrodes at a third sustaining discharge potential which is lower than said first sustaining discharge potential;

a fourth sustaining discharge supply circuit for setting said potentials of said scanning electrodes at a fourth sustaining discharge potential which is higher than said second sustaining discharge potential;

a fifth sustaining discharge supply circuit for setting said potentials of said sustaining electrodes at a fifth sustaining discharge potential;

a sixth sustaining discharge supply circuit for setting said potentials of said scanning electrodes at a sixth sustaining discharge potential which is lower than said fifth sustaining discharge potential;

a seventh sustaining discharge supply circuit for setting said potentials of said sustaining electrodes at a seventh sustaining discharge potential which is higher than said fifth sustaining discharge potential; and an eighth sustaining discharge supply circuit for setting said potentials of said scanning electrodes at an eighth sustaining discharge potential which is lower than said sixth sustaining discharge potential, wherein for every sustaining pulses causing said scanning electrodes to be higher in potential than said sustaining electrodes, said first and second sustaining discharge supply circuits are operated to cause a first sustaining discharge between said sustaining electrodes and said scanning electrodes, and subsequently, said third and fourth sustaining discharge supply circuits are operated to cause a second sustaining discharge between said sustaining electrodes and said scanning electrodes, and wherein for every sustaining pulses causing said scanning electrodes to be lower in potential than said sustaining electrodes, said fifth and sixth sustaining discharge supply circuits are operated to cause a third sustaining discharge between said sustaining electrodes and said scanning electrodes, and subsequently, said seventh and eighth sustaining discharge supply circuits are operated to cause a fourth sustaining discharge between said sustaining electrodes and said scanning electrodes.

4. The circuit as claimed in claim 3, further including a control circuit for controlling a time period of setting said potentials of said sustaining electrodes at first sustaining discharge potential.

5. A method as claimed in claim 4, wherein said time period is in the range of 100 nanoseconds to 300 nanoseconds.

6. A method of driving a sustaining pulse for a plasma display panel, including the steps of:

applying a sustaining discharge voltage for each sustaining pulse;

causing a step-by-step increase of said sustaining discharge voltage over plural steps, to selectively cause respective sustaining discharges on said plural steps;

wherein a continuous discharge current is sustained during a series of said sustaining discharges based on each said sustaining pulse, and wherein after an initial step of the increase in said sustaining discharge voltage, said sustaining discharge voltage is decreased and then increased toward a next step of the increase; and controlling respective sustaining discharge application periods for said receptive sustaining discharges on said plural steps, wherein the controlling step is accomplished so that a time difference between steps of said plural steps is in the range of 100 nanoseconds to 300 nanoseconds.

7. A circuit for driving sustaining pulses for a plasma display panel, said circuit comprising:

a first sustaining discharge supply circuit for setting potentials of sustaining electrodes at a first sustaining discharge potential;

a second sustaining discharge supply circuit for setting potentials for scanning electrodes at a second sustaining discharge potential which is higher than said first sustaining discharge potential;

a third sustaining discharge supply circuit for setting said potentials of said sustaining electrodes at a third sustaining discharge potential;

a fourth sustaining discharge supply circuit for setting said potentials of scanning electrodes at a fourth sustaining discharge potential which is higher than said third sustaining discharge potential;

a fifth sustaining discharge supply circuit for setting said potentials of said sustaining discharge potential;

a sixth sustaining discharge supply circuit for setting said potentials of said scanning electrodes at a sixth sustaining discharge potential which is lower than said fifth sustaining discharge potential;

a seventh sustaining discharge supply circuit for setting said potentials of said sustaining electrodes at a seventh sustaining discharge potential; and an eighth sustaining discharge supply circuit for setting said potentials of said scanning electrodes at an eighth sustaining discharge potential which is lower than said seventh sustaining discharge potential, wherein for every sustaining pulses causing said scanning electrodes to be higher in potential than said sustaining electrodes, said first and second sustaining discharge supply circuit are operated to cause a first sustaining discharge between said sustaining electrodes and said scanning electrodes, and subsequently, said first, second, third and fourth sustaining discharge supply circuit are operated at the same time to cause a second sustaining discharge between said sustaining electrodes and said scanning electrodes, and wherein for every sustaining pulses causing said scanning electrodes to be lower in potential than said sustaining electrodes, said fifth and sixth sustaining discharge supply circuit are operated to cause a third sustaining discharge between said sustaining electrodes and said scanning electrodes, and subsequently, said first, sixth, seventh and eighth sustaining discharge supply circuits are operated at the same time to cause a fourth sustaining discharge between said sustaining electrodes and said scanning electrodes.

8. The method as claimed in claim 7, wherein said first sustaining discharge supply circuit has a larger output impedance than said third sustaining discharge supply circuit, and said second sustaining discharge supply circuit has a larger output impedance than said fourth sustaining discharge supply circuit.

9. The circuit as claimed in claim 7, further including a control circuit for controlling respective timings of starting respective operations of said first and third sustaining discharge supply circuit.

10. The method as claimed in claim 9, wherein a delayed time of starting operation of said third sustaining discharge supply circuit from starting operation of said first sustaining discharge supply circuit.

11. A circuit for driving sustaining discharge pulses for a plasma display panel, said circuit comprising:

first and second sustaining discharge supply circuits for setting a voltage difference between sustaining electrodes and scanning electrodes at a first sustaining discharge voltage in a sustaining discharge pulse, which is over a discharge initiation voltage;

third and fourth sustaining discharge supply circuits for setting voltage difference at a second sustaining discharge voltage in said sustaining pulse, which is higher than said first sustaining discharge voltage.

12. The circuit as claimed in claim 11, further including a control circuit for controlling times of setting said first and second sustaining discharge voltages.

13. The method as claimed in claim 12, wherein said second sustaining voltage is set 100 nanoseconds to 300 nanoseconds after the first sustaining voltage is set.

14. A circuit for driving sustaining pulses for a plasma display panel, said circuit comprising:

a first slope circuit for setting a voltage difference between sustaining electrodes and scanning electrodes;

first and second sustaining discharge supply circuits for setting the voltage difference between sustaining electrodes and scanning electrodes at a first sustaining discharge voltage, which is over a discharge initiation voltage, within a period of each sustaining pulse, third and fourth sustaining discharge supply circuits for setting the voltage difference at a second sustaining discharge voltage, which is over a discharge initiation voltage, within said period of said each sustaining pulse, wherein the supplying current capability of said third and fourth sustaining discharge supply circuits is larger than that of said first and second sustaining discharge supply circuits.

15. The circuit as claimed in claim 14, wherein said first and second sustaining discharge supply circuits cause a first sustaining discharge between said sustaining electrodes and said scanning electrodes, and subsequently, said first through fourth sustaining discharge supply circuits operate together to cause a second sustaining discharge between said sustaining electrodes and said scanning electrodes.

16. The circuit as claimed in claim 14, further including a control circuit for controlling respective timing of starting respective operations of said first slope circuit and said first through fourth sustaining discharge supply circuits.

17. The circuit as claimed in claim 16, wherein said control circuit sets a delayed time of said starting operation of said third and fourth sustaining discharge supply circuits from said starting operation of said first and second sustaining discharge supply circuits in the range of 100 nanoseconds to 300 nanoseconds.

18. A method of driving a sustaining pulse for a plasma display panel, said method including the steps of:

operating first and second circuits to set a voltage difference between sustaining electrodes and scanning electrodes at a first sustaining discharge voltage, which is higher than a discharge initiation voltage, within a period of each sustaining pulse; and operating third and fourth circuits to set said voltage difference at a second sustaining discharge voltage, which is higher than said first sustaining discharge voltage, within said period of said each sustaining pulse.

19. A method of driving a sustaining pulse for a plasma display panel, said method including the steps of:

a first step of setting a voltage difference between sustaining electrodes and scanning electrodes at a first sustaining discharge voltage, which is higher than a discharge initiation voltage, within a period of each sustaining pulse; and a second step of setting said voltage difference at a second sustaining discharge voltage, which is also higher than said discharge initiation voltage, within said period of said each sustaining pulse, wherein said second sustaining discharge voltage is higher than said sustaining discharge voltage.

* * * * *